US005447830A

United States Patent [19]

Pawlak et al.

[11] Patent Number: 5,447,830

[45] Date of Patent: Sep. 5, 1995

[54] 3-ANILINO PYRAZOLONE MAGENTA COUPLERS AND PROCESS

[75] Inventors: John L. Pawlak; David S. Bailey, both of Rochester; William R. Schleigh, Brockport; Charles E. Romano; Paul B. Merkel, both of Rochester; Sundaram Krishnamurthy, Penfield, all of N.Y.

[73] Assignee: Eastman Kodak Company, Rochester, N.Y.

[21] Appl. No.: 83,842

[22] Filed: Jun. 25, 1993

Related U.S. Application Data

[63] Continuation-in-part of Ser. No. 872,576, Apr. 23, 1992, abandoned, which is a continuation-in-part of Ser. No. 689,436, Apr. 23, 1991, Pat. No. 5,298,368.

[51] Int. Cl.[6] ..... G03C 7/384

[52] U.S. Cl. ..... 430/504; 430/555

[58] Field of Search ..... 430/555, 359, 504

[56] References Cited

U.S. PATENT DOCUMENTS

| | | | |
|---|---|---|---|
| 5,250,405 | 10/1993 | Merkel et al. | 430/544 |
| 5,256,528 | 10/1993 | Merkel et al. | 430/555 |
| 5,262,292 | 11/1993 | Krishnamurthy | 430/555 |
| 5,298,368 | 3/1994 | Merkel et al. | 430/554 |

FOREIGN PATENT DOCUMENTS

| | | | |
|---|---|---|---|
| 2-40649 | 2/1990 | Japan . | |
| 2040648 | 2/1990 | Japan | 430/555 |

*Primary Examiner*—Lee C. Wright
*Attorney, Agent, or Firm*—Arthur E. Kluegel

[57] ABSTRACT

Magenta image-dye couplers provide photographic elements and processes having superior photographic properties. The couplers are 3-anilino pyrazolone couplers having an aryl thio coupling-off group. The substituents of the coupler are specified to obtain advantageous properties.

14 Claims, No Drawings

3-ANILINO PYRAZOLONE MAGENTA COUPLERS AND PROCESS

CROSS REFERENCE TO RELATED APPLICATION

This application is a continuation-in-part of U.S. Ser. No. 07/872,576 filed Apr. 23, 1992, now abandoned which is in turn a continuation-in-part of U.S. Ser. No. 07/689,436 which was filed on Apr. 23, 1991, U.S. Pat. No. 5,298,368.

BACKGROUND OF THE INVENTION

This invention relates to 3-anilinopyrazolone magenta dye-forming couplers having a particular parent group and thio coupling-off group that enables improved photographic properties and to photographic materials and processes comprising such couplers.

In color photographic silver halide materials and processes so-called four equivalent 3-anilino pyrazolone couplers have provided magenta dye images having useful properties. Examples of such compounds are described in, for example, U.S. Pat. Nos. 3,907,571, 3,928,044, 3,935,015, 4,199,361 and 3,519,429. An example of one such pyrazolone coupler, described in, for example, U.S. Pat. No. 3,519,429 is herein designated as comparison coupler C-1 and is represented by the formula:

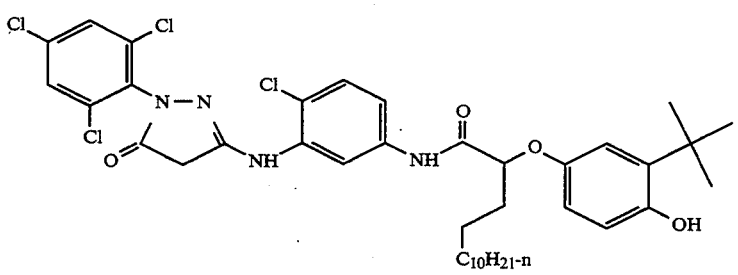

C-1

This prior art coupler has a number of disadvantages. Since C-1 is a four-equivalent coupler, more silver halide and coupler must be used to obtain adequate dye yield, when compared to two-equivalent couplers. This increases the costs associated with this type of coupler. In addition, the dye dark stability is quite poor and the coupler itself causes substantial yellow stain in areas of minimum density, especially when kept under humid conditions.

In color photographic silver halide materials and processes, pyrazolone couplers comprising arylthio coupling-off groups have provided magenta dye images having useful properties. Examples of such compounds are described in, for example, U.S. Pat. No. 4,413,054, Japanese published patent application 60/057839, U.S. Pat. Nos. 4,876,182, 4,900,657 and 4,351,897. An example of such a pyrazolone coupler described in, for example, U.S. Pat. No. 4,413,054 is designated herein as comparison coupler C-2 and is represented by the formula:

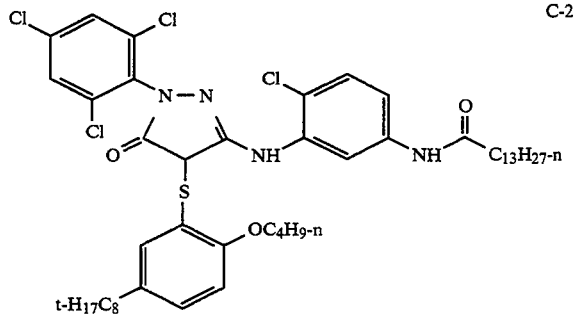

C-2

The presence of an alkoxy group in the ortho position on the phenylthio coupling-off group of coupler C-2 has provided advantageous properties. However, this coupler has not been entirely satisfactory due to formation of undesired stain in a color photographic silver halide element upon exposure and processing and because it does not provide desired image-dye density upon rapid machine processing. The coupler C-2 does not achieve full dye density, especially when the exposed color photographic element is machine processed without Lippman fine grain silver halide being present in the photographic element which can be used to effect complete conversion of the leuco-dye to image dye. It has been desirable to reduce or avoid the need for added Lippman fine grain silver halide without diminishing dye density in the processed color photographic silver halide element. It is believed that the alkoxy substituent undesirably stabilizes the leuco-dye thus preventing the completion of the dye formation process during development. This leads to loss of expected density and unpredictable results due to post-development dye formation. The prior art coupler C-2 does not therefore meet the industry needs.

Another example of a pyrazolone coupler known to the art, described in U.S. Pat. No. 4,853,319, is designated herein as comparison coupler C-3 and is represented by the formula:

C-3

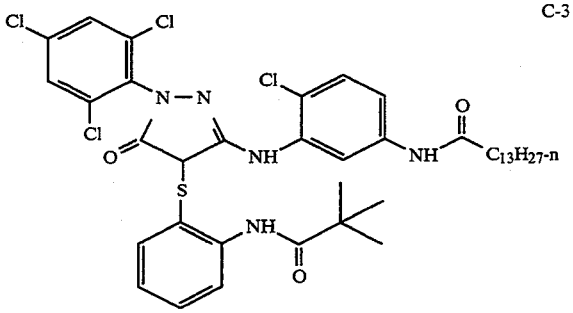

The presence of an acylamine group in the ortho position on the phenylthio coupling-off group of coupler C-3 has provided advantageous properties. This coupler does not require Lippman fine grain silver halide in order to obtain adequate dye density upon rapid machine processing. However, this type of coupler does suffer from unwanted gains in green density in unexposed areas upon standing in the dark. Another problem with couplers of this type is that in the presence of polyvalent cations such as calcium, the amount of dye formed from a given amount of exposure is reduced relative to a process with no polyvalent cations. In particular, increasing amounts of calcium ion in a seasoned process leads to unacceptable losses in dye yield with this type of coupler.

Another example of a pyrazolone coupler known to the art, described in U.S. Pat. No. 4,853,319 is designated herein as comparison coupler C-4 and is represented by the formula:

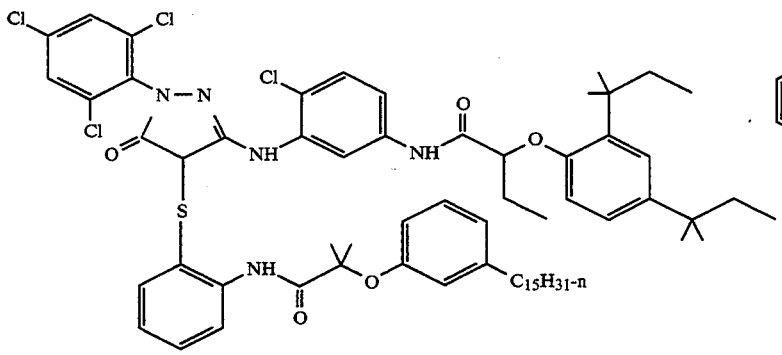

This coupler also does not require Lippman fine grain silver halide in order to obtain adequate dye density upon rapid machine processing. However, this type of coupler also gives reduced dye yields in the presence of polyvalent cations, in particular, calcium ion.

Another type of coupler that has been considered is one having a pentachloro- substitution on the N phenyl ring (U.S. Pat. No. 4,876,182). While such materials provide advantageous properties they are not preferred because rings containing more than 3 chloro substituents present laborious and costly administrative orders relative to disposal.

It has been desired to provide a new 3-anilinopyrazolone coupler having a phenylthio coupling-off group in a color photographic silver halide element and process which is capable of forming a magenta dye image of good stability, with high dye yield based on rapid machine processing, and with reduction or omission of Lippman fine grain silver halide in the element. In addition, it has been desired to provide such a coupler which displays reduced sensitivity to polyvalent metal cations commonly found in photographic processes, specifically calcium ion. Also, it has been desired to provide such a coupler which displays excellent thermal stability in areas of no light exposure. Further, it has been desired to provide a new pyrazolone coupler which provides a magenta dye after photographic processing that has a hue suitable for optimal color reproduction and color saturation. The couplers disclosed in U.S. Pat. No. 4,853,319 that gave dyes with good hue for optimal color reproduction were generally unstable on keeping and formed undesirable stain in areas of minimum density. Finally, it has been desired to provide a new pyrazolone coupler that has high activity. High activity couplers allow for reduced material laydowns of the magenta coupler and silver halide, which in turn leads to reduced costs and improved optical quality.

SUMMARY OF THE INVENTION

It has now been found that the foregoing problems can be solved by using the materials and process of this invention. The photographic element of the invention contains a support bearing at least one silver halide emulsion layer having associated therewith a 5-pyrazolone photographic coupler represented by the formula:

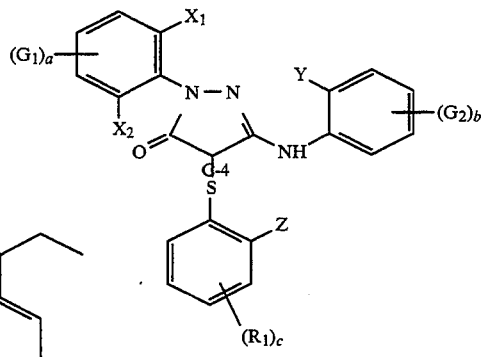

wherein a) substituents $X_1$, $X_2$, Y, $G_1$, and $G_2$ are individually selected from the group of halogen, alkyl, alkoxy, aryloxy, acylamino, alkylthio, arylthio, sulfonamido, sulfamoyl, sulfamido, carbamoyl, diacylamino, alkoxycarbonyl, aryloxycarbonyl, alkoxysulfonyl, aryloxysulfonyl, alkylsulfonyl, alkylsulfoxyl, arylsulfoxyl, arylsulfonyl, alkoxycarbonylamino, aryloxycarbonylamino, alkylureido, arylureido, acyloxy, nitro, cyano, trifluoromethyl and carboxy, and, in the case of $X_1$, $X_2$ and Y, hydrogen;

b) a, b, and c are individually integers from 0 to 3 provided that "a" cannot be an integer which, combined with the selection of $X_1$ and $X_2$, allows the number of chloride substituents on the ring containing $G_1$ to exceed 3;

c) $R_1$ is selected from $G_1$ and hydroxyl;

d) Z is selected from carbamoyl, alkoxysulfonyl, aryloxysulfonyl, alkylsulfonyl, arylsulfonyl, alkoxycarbonyl, aryloxycarbonyl, sulfamoyl, acyloxy, nitro, cyano, and an amine group of the formula:

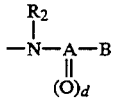

wherein $R_2$ is selected from the group consisting of hydrogen, alkyl, alkenyl, aryl, acyl, and heterocyclic;

A is carbon or sulfur, and d is 1 when A is carbon and 1 or 2 when A is sulfur;

B is selected from alkyl, aryl, and heterocyclic groups bonded to A by an atom of oxygen, nitrogen, sulfur, or carbon of the group B, wherein, in the case of a carbon bond, B has the formula:

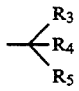

wherein $R_3$, $R_4$, and $R_5$ are individually selected from hydrogen, halogen, alkyl, aryl, heterocyclic group and W, wherein W is selected from —$OR_6$, —$SR_6$, and —$NR_7R_8$, wherein $R_6$ is selected from alkyl, aryl, and heterocyclic groups, and $R_7$ and $R_8$ are individually selected from hydrogen, alkyl, aryl, acyl, alkylsulfonyl, arylsulfonyl and heterocyclic group, provided that when A is carbon at least one of $R_3$, $R_4$, and $R_5$ is not hydrogen or alkyl and provided that two of $R_3$, $R_4$ and $R_5$ may join to form an aliphatic, aromatic or heterocyclic ring; and e) the sum of the sigma values for $X_1$, $X_2$, $G_1$, $G_2$, and Y is at least 1.3.

DETAILED DESCRIPTION OF THE INVENTION

In a preferred pyrazolone coupler represented by the above formula,

Z is represented by the formula:

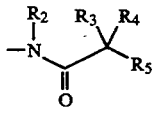

where $R_2$ is selected from hydrogen, alkyl, alkenyl, aryl, acyl, and heterocyclic, where $R_3$ is selected from W, aryl, and heterocyclic group;

$R_4$ and $R_5$ are individually selected from W, hydrogen, halogen, alkyl, aryl, and heterocyclic group;

W is selected from —$OR_6$—, —$SR_6$, and —$NR_7R_8$;

$R_6$ is selected from alkyl, aryl, and heterocyclic group;

$R_7$ and $R_8$ individually are selected from hydrogen, alkyl, aryl, acyl, alkylsulfonyl, arylsulfonyl and heterocyclic group.

$R_2$ and $R_3$ optionally join to form an alicyclic or heterocyclic ring, and two of $R_3$, $R_4$ and $R_5$ optionally join to form an alicyclic, aromatic, or heterocyclic ring (where, under such circumstances, the remaining substituent may be eliminated as a substituent and become a pi bond in the case of an aromatic compound or, in the case of a nonaromatic unsaturated aliphatic or heterocyclic ring may be a bond forming part of a double bond in the ring).

It is understood throughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form but also its form substituted with any substituents which do not negate the advantages of this invention. It is further intended that the organic substituents shall not exceed 30 carbon atoms and shall preferably not exceed 20 carbon atoms.

Among the compounds defined above, a particularly preferred pyrazolone coupler is represented by the above formula wherein Z is represented by the formula:

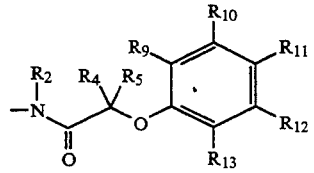

wherein $R_2$ is as defined above;

$R_4$ and $R_5$ are individually selected from W, hydrogen, halogen, alkyl, aryl, and heterocyclic group;

W is selected from —$OR_6$, —$SR_6$, and —$NR_7R_8$;

$R_6$ is selected from alkyl, aryl, and heterocyclic group;

$R_7$ and $R_8$ individually are selected from hydrogen, alkyl, aryl, acyl, alkylsulfonyl, arylsulfonyl and heterocyclic group;

$R_9$, $R_{10}$, $R_{11}$, $R_{12}$ and $R_{13}$ are individually selected from hydrogen, halogen, nitro, cyano, carboxy, aryl, alkyl, alkoxy, aryloxy, acylamino, sulfonamido, sulfamoyl, sulfamido, carbamoyl, diacylamino, aryloxycarbonyl, alkoxycarbonyl, alkoxysulfonyl, aryloxysulfonyl, alkylsulfoxyl, arylsulfoxyl, alkylsulfonyl, arylsulfonyl, alkylthio, arylthio, alkoxycarbonylamino, alkylureido, arylureido, and acyl.

The parameters sigma and pi have well established values. The values for these constants can be easily found in the published literature (C. Hansch and A. J. Leo, in "Substituent Constants for Correlation Analysis in Chemistry and Biology", Wiley, New York, 1979; Albert J. Leo, in "Comprehensive Medicinal Chemistry", edited by C. Hansch, P. G. Sammes, and J. B. Taylor, Pergamon Press, New York, Volume 4, 1990. "The Chemists' Companion", A. J. Gordon and R. A. Ford, John Wiley & Sons, New York, 1972 and "Progress in Physical Organic Chemistry", V. 13, R. W. Taft, Ed., John Wiley & Sons, New York.) Generally, pi increases with increasing lipophilicity (of the ring substituent with hydrogen=zero) and sigma increases with increasing electron withdrawing power of the substituent with hydrogen=zero. In calculating the values of pi, all of the components of a substituent must be considered. For sigma, only the atoms close to the ring have an electron withdrawing effect and remote atoms have no effect.

The pyrazolone coupler can be a monomeric, dimeric, trimeric, oligomeric or polymeric coupler, wherein the coupler moiety can be attached to the polymeric backbone via a substituent on the pyrazolone nucleus, or a substituent of the coupling-off group.

Examples of $G_1$, $G_2$, $X_1$, $X_2$, Y, $R_1$, $R_9$, $R_{10}$, $R_{11}$, $R_{12}$ and $R_{13}$ include halogen, such as chlorine, bromine or fluorine; alkyl, including straight or branched chain alkyl, such as alkyl containing 1 to 30 carbon atoms, for example methyl, trifluoromethyl, ethyl, t-butyl, and tetradecyl; alkoxy, such as alkoxy containing 1 to 30 carbon atoms, for example methoxy, ethoxy, 2-ethylhexyloxy and tetradecyloxy; acylamino, such as acetamido, benzamido, butyramido, tetradecanamido, α-(2,4-di-t-pentylphenoxy)-acetamido, α-(2,4-di-t-pentylphenoxy)butyramido, α-(3-pentadecylphenoxy)hexanamido, α-(4-hydroxy-3-t-butylphenoxy) tetradecanamido, 2-oxo-pyrrolidin-l-yl, 2-oxo-5-tetradecyl-pyrrolin-1-yl, N-methyltetradecanamido, and t-butylcarbonamido; sulfonamido, such as methanesulfonamido, benzenesulfonamido, p-toluenesulfonamido, p-dodecylbenzenesulfonamido, N-methyltetradecylsulfonamido, and hexadecanesulfonamido; sulfamoyl, such as N-methylsulfamoyl, N-hexadecylsulfamoyl, N, N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as N-methylsulfamido and N-octdecylsulfamido; carbamoyl, such as N-methylcarbamoyl, N-octadecylcarbamoyl, N-[4-(2,4-di-tpentylphenoxy)butyl]carbamoyl, N-methyl-Ntetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl. Alkanesulfonyl, such as alkanesulfonyl containing 1 to 30 carbon atoms, for example methanesulfonyl, octanesulfonyl, 2-ethylhexanesulfonyl, and hexadecanesulfonyl; arenesulfonyl, such as benzenesulfonyl, 4-nonylbenzenesulfonyl, and p-toluenesulfonyl; alkylthio, such as alkylthio containing 1 to 22 carbon atoms, for example ethylthio, octylthio, benzylthio, tetradecylthio, and 2-(2,4-di-t-pentylphenoxy)ethylthio; arylthio, such as phenylthio and p-tolylthio; alkoxycarbonylamino, such as ethoxycarbonylamino, benzyloxycarbonylamino, and hexadecyloxycarbonylamino; alkylureido, such as N-methylureido, N, N-dimethylureido, N-methyl-N-dodecylureido, N-hexadecylureido, N, N-dioctadecylureido, and N, N-dioctyl-N'-ethyl-ureido; acyloxy, such as acetyloxy, benzoyloxy, octadecanoyloxy, p-dodecanamidobenzoyloxy, and cyclohexanecarbonyloxy; nitro; cyano and carboxy (—COOH) and, except for $G_1$, $G_2$ and $R_1$, hydrogen.

Examples of Y as alkoxy include methoxy, ethoxy, propoxy, butoxy, 2-methoxyethoxy, sec-butoxy, hexyloxy, 2-ethylhexyloxy, 2-(2,4-di-t-pentylphenoxy) ethoxy, and 2-dodecyloxyethoxy. Examples of Y as aryloxy include phenoxy, α- β-naphthyloxy, and 4-tolyloxy.

The term "coupler" herein refers to the entire compound, including the coupler moiety and the coupling-off group. The term "coupler moiety" "(COUP)" or parent refers to that portion of the compound other than the coupling-off group.

The coupler moiety (COUP) can be any 3-anilinopyrazolone coupler moiety useful in the photographic art to form a color reaction product particularly a magenta dye, with oxidized color developing agent provided the substituents meet the requirements above described. Useful pyrazolone coupler moieties are described in, for example, U.S. Pat. Nos. 4,413,054; 4,853,319; 4,443,536; 4,199,361; 4,351,897; 4,385,111; Japanese Published Patent Application 60/170854; U.S. Pat. Nos. 3,419,391; 3,311,476; 3,519,429; 3,152,896; 2,311,082; and 2,343,703; the disclosures of which are incorporated herein by reference. The coupling-off group, if any, on the pyrazolone coupler moiety described in these patents or patent applications can be replaced by a coupling-off group according to the invention. The pyrazolone coupler according to the invention can be in a photographic element in combination with other magenta couplers known or used in the photographic art, such as in combination with at least one of the pyrazolone couplers described in these patents or published patent applications of the invention. The COUP portion of the couplers can be obtained as is known to the art. For example, syntheses of COUP moieties are described in Item 16736 in Research Disclosure, Mar. 1978; U.K. Patent Specification 1,530,272; U.S. Pat. Nos. 3,907,571; and 3,928,044.

In a particular embodiment, the coupling-off group contains a Z substituent which is a carbonamido group of the formula:

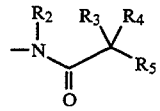

where the carbon connecting $R_3$, $R_4$, and $R_5$ to the carbonyl carbon is nonchiralic. Typically, two or more of the $R_3$, $R_4$, and $R_5$ substituents may be hydrogen or methyl, for example. It is also possible that two of the substituents may be joined to form a ring which is nonchiralic if the ring is symmetric about the central carbon. It has been found suitable to employ as one of the substituents an aryloxy compound (—$OR_6$) and particularly suitable to employ an alkylaryloxy containing one or more alkyl substituents where the alkyl substituents are less than 30 carbon atoms, and typically less than 24 carbon atoms. It has also been found desirable under such circumstances to employ a sulfone as an electron-withdrawing group on the coupler parent, normally on the anilino ring.

Illustrative couplers include:

M-1
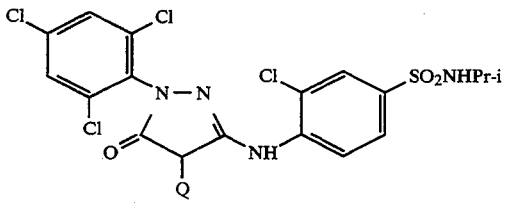
M-2
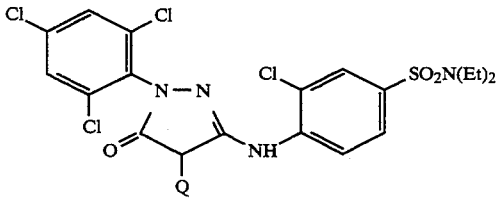
M-3
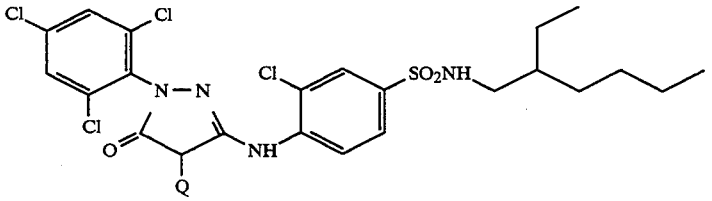
M-4
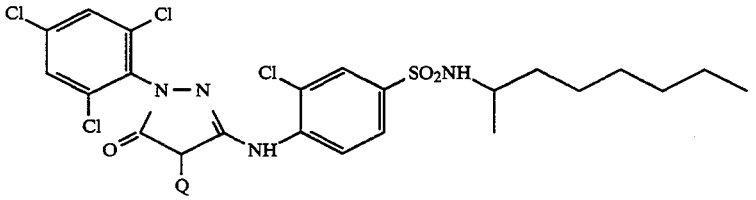
M-5
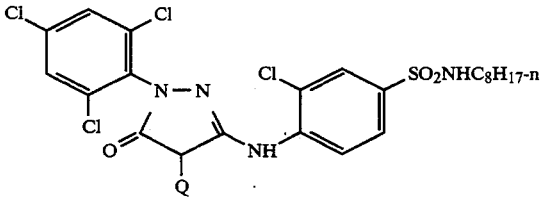
M-6
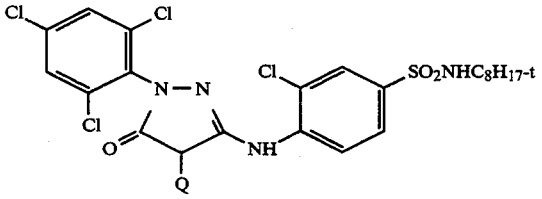
M-7
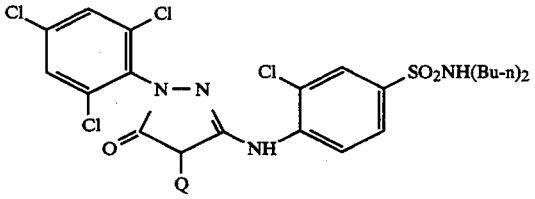

-continued
M-8
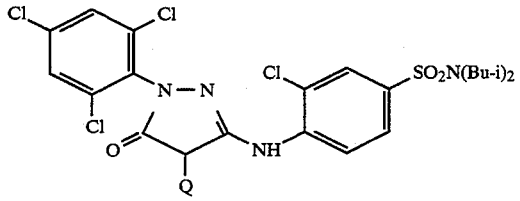
M-9
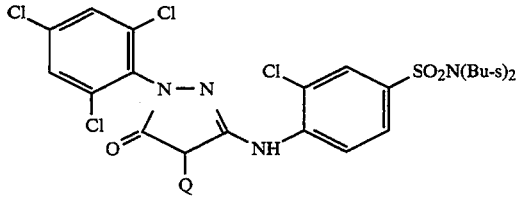
M-10
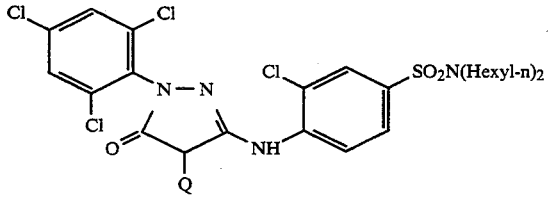
M-11
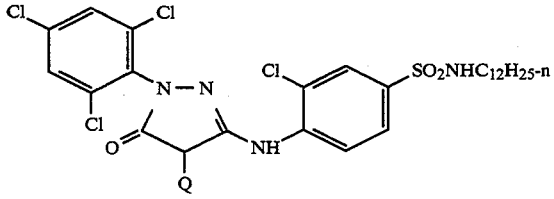
M-12
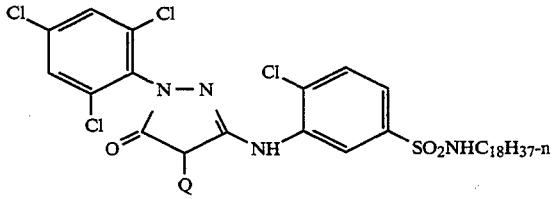
M-13
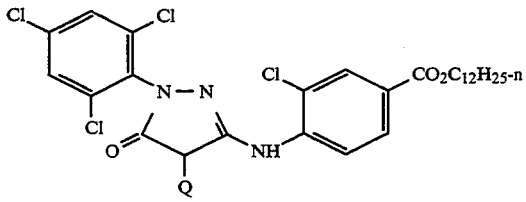
M-14
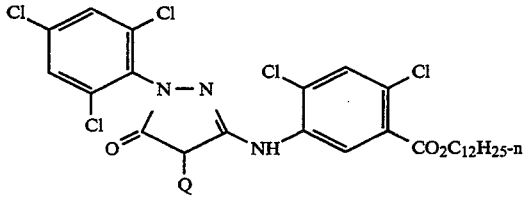
M-15
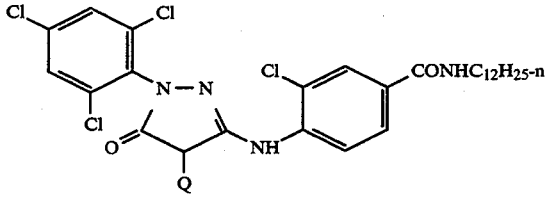

-continued
M-16
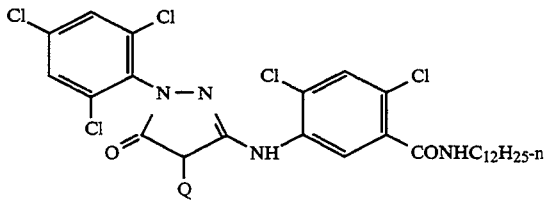
M-17
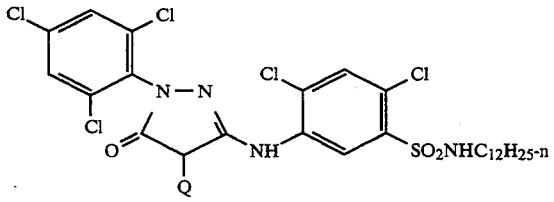
M-18
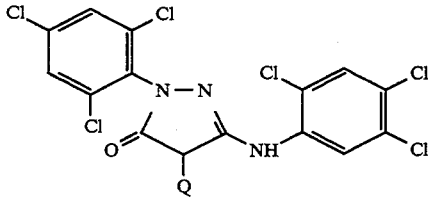
M-19
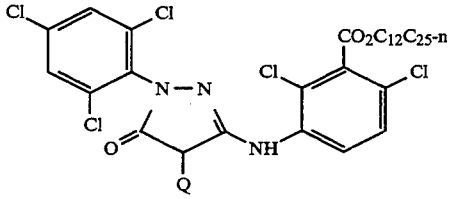
M-20
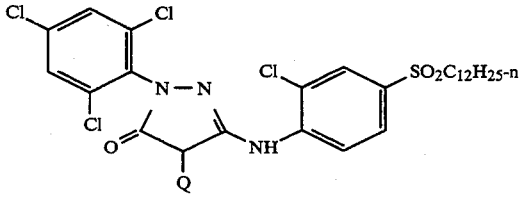
M-21
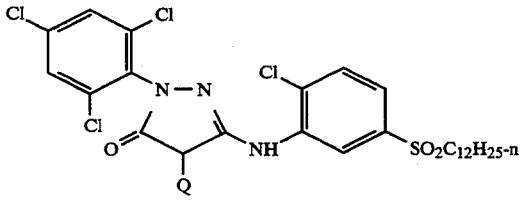
M-22
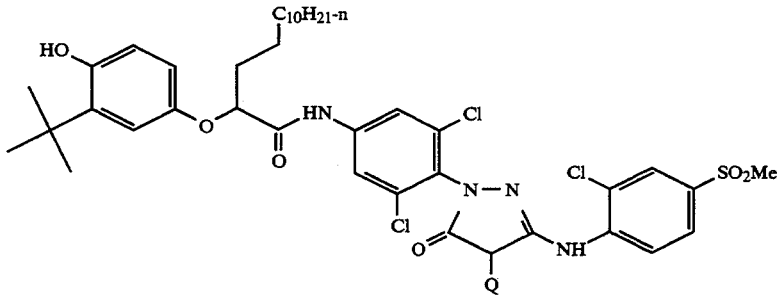

-continued

M-23

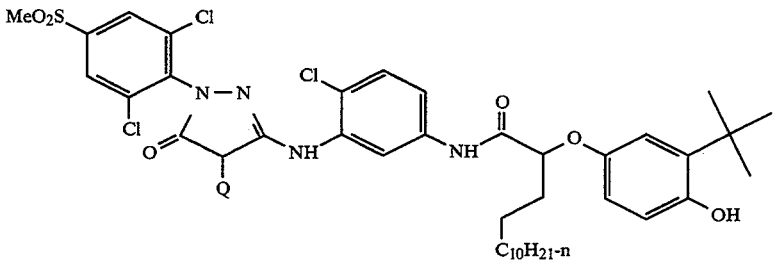

Q herein represents a coupling-off group according to the invention. Examples of Z include sulfamoyl, such as N-methylsulfamoyl, N-hexadecylsulfamoyl, N, N-dimethylsulfamoyl; N-[3-(dodecyloxy)propyl]sulfamoyl, N-[-(2,4-di-t-pentylphenoxy)butyl]-sulfamoyl, N-methyl-N-tetradecylsulfamoyl; and N-dodecylsulfamoyl; carbamoyl, such as N-methylcarbamoyl, N-octadecylcarbamoyl, N-[4-(2,4-di-t-pentylphenoxy)-butyl]carbamoyl, N-methyl-N-tetradecylcarbamoyl, and N,N-dioctylcarbamoyl; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl, alkylsulfonyl, such as alkylsulfonyl containing 1 to 30 carbon atoms, for example methanesulfonyl, octanesulfonyl, 2-ethylhexanesulfonyl, and hexadecanesulfonyl; arylsulfonyl, such as benzenesulfonyl, 4-nonylbenzenesulfonyl, and p-toluenesulfonyl; acyloxy; such as acetyloxy, benzpyloxy, octadecanoyloxy, p-dodecanamidobenzoyloxy, and cyclohexanecarbonyloxy; nitro; cyano, acyloxy and specified carbonamido and sulfonamido compounds. Illustrative coupling-off groups (Q) are as follows:

Q-1

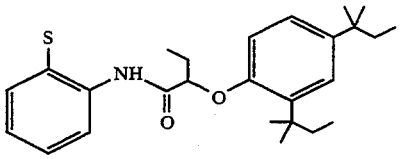

Q-2

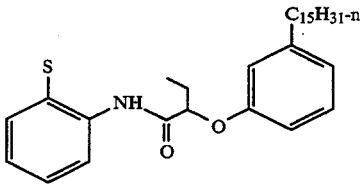

Q-3

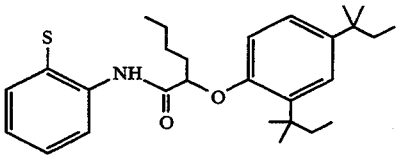

-continued

Q-4

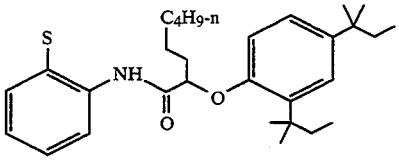

Q-5

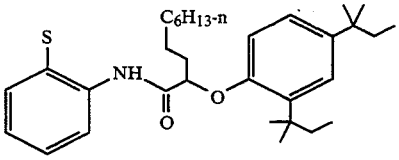

Q-6

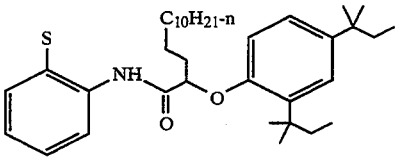

Q-7

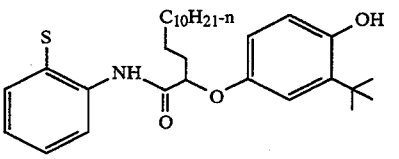

Q-8

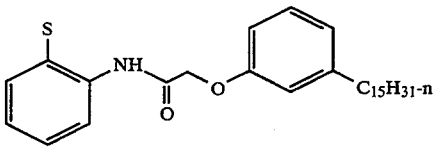

Q-9

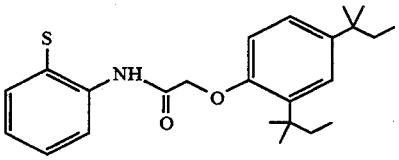

Q-10

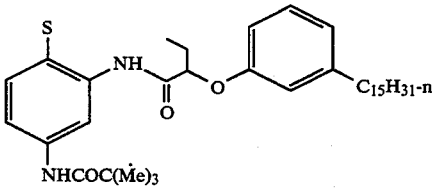

-continued
Q-11
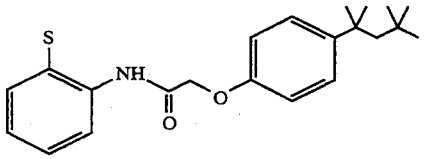
Q-12
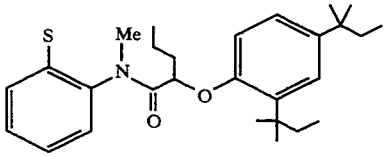
Q-13
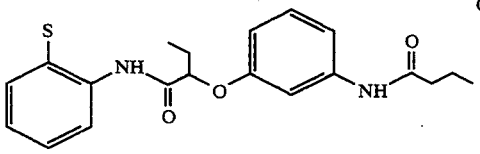
Q-14
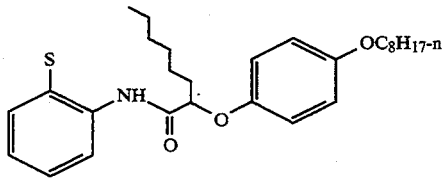
Q-15
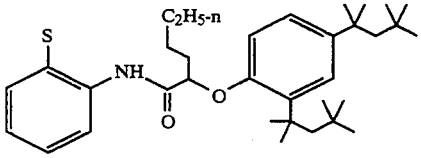
Q-16
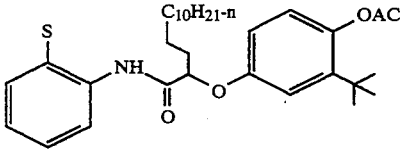
Q-17
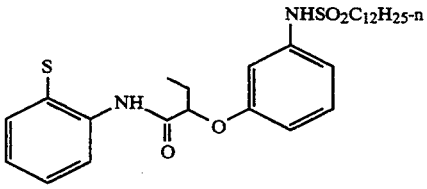
Q-18
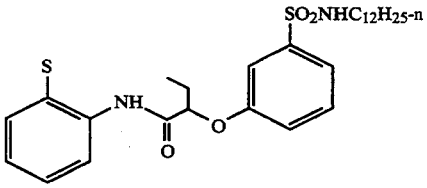
-continued
Q-19
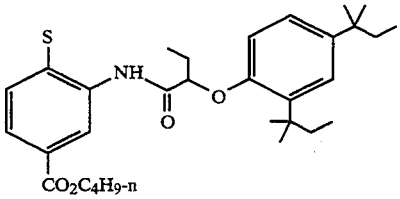
Q-20
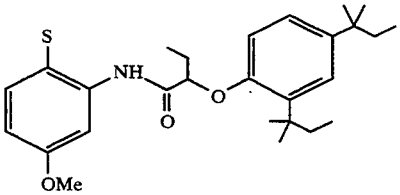
Q-21
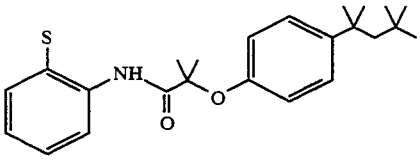
Q-22
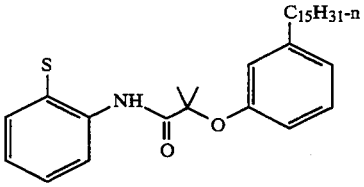
Q-23
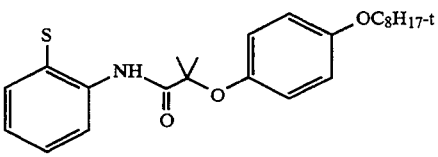
Q-24
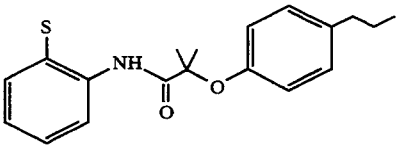
Q-25
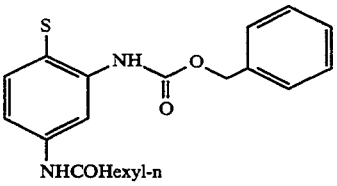
Q-26
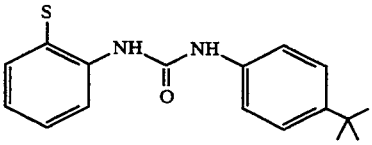
Q-27
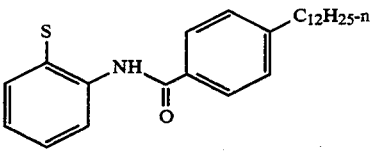

-continued
Q-28
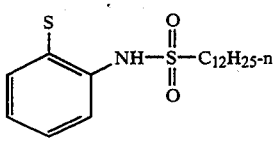
Q-29
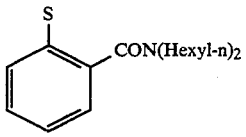
Q-30
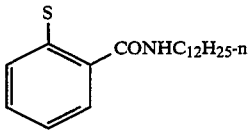
Q-31
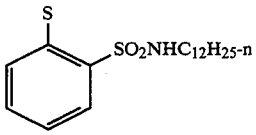
Q-32
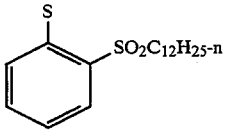
Q-33
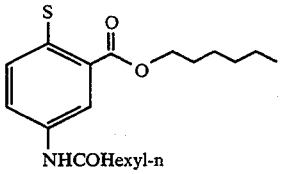
Q-34
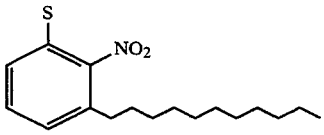
Q-35
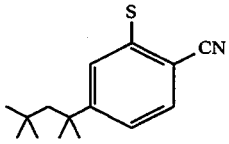
Q-36
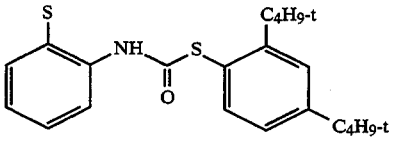
Q-37
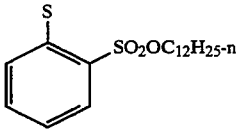
Q-38
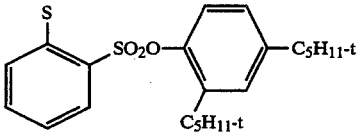
-continued
Q-39
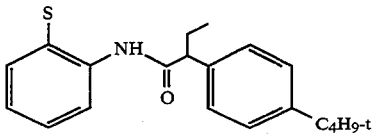
Q-40
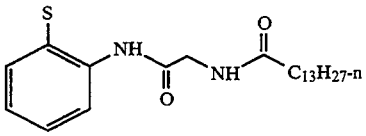
Q-41
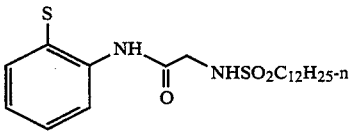
Q-42
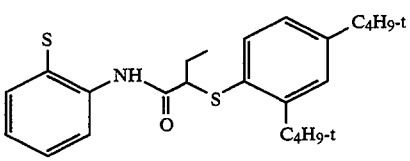
Q-43
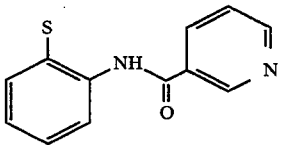
Q-44
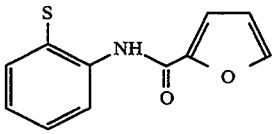
Q-45
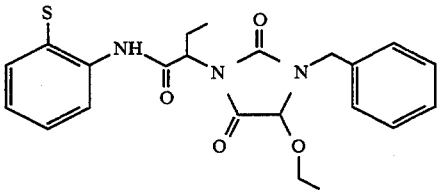
Q-46
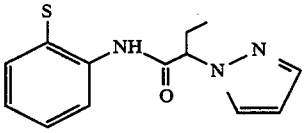
Q-47
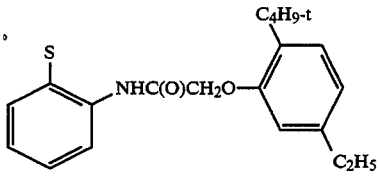
Q-48
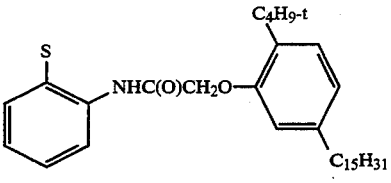

The pyrazolone couplers preferably comprise a ballast group. The ballast group can be any ballast known in the photographic art. The ballast is typically one that does not adversely affect reactivity, stability and other desired properties of the coupler of the invention and does not adversely affect the stability, hue and other desired properties of the dye formed from the coupler. Illustrative useful ballast groups are described in the following examples.

Couplers of this invention can be prepared by reacting the parent 4-equivalent coupler containing no coupling-off group with the aryl disulfide of the coupling-off group according to the invention. This is a simple method and does not involve multiple complicated synthesis steps. The reaction is typically carried out in a solvent, such as dimethylformamide or pyridine.

The couplers according to the invention can be prepared by the following illustrative synthetic scheme, where COUP represents the coupler moiety having the coupling-off group attached at its coupling position:

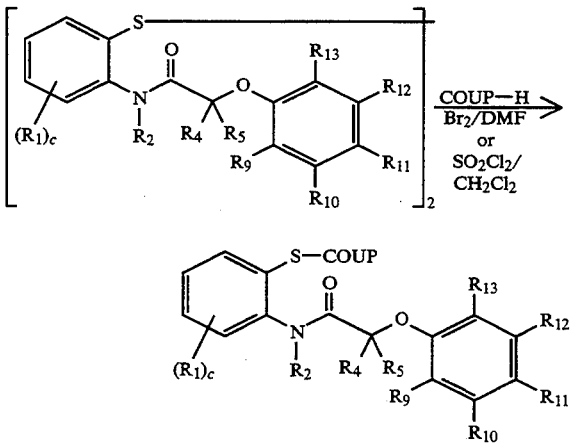

wherein COUP is the coupler moiety and $R_1$, $R_2$, $R_4$, $R_5$, and $R_9$ through $R_{13}$ are as defined.

The following examples illustrate the preparation of couplers of this invention.

Synthesis Example A: Synthesis of the Coupling Off Group.

Synthesis of o-Aminophenyt Disulfide

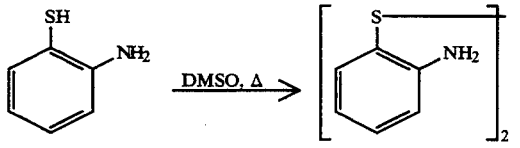

A 1-L flask equipped with a magnetic stirring bar and a reflux condenser was charged with o-aminobenzenethiol (200 g, 1.6 moles) and dimethylsulfoxide (500 mL). The well stirred mixture was gently heated (~50° C.); the reaction was monitored to completion (2.5 hr, TLC, ligroin 950:EtOAc, 2:1). The mixture was poured into crushed ice. The product, o-aminophenyl disulfide was collected as a greenish yellow solid (169 g, 85% yield). This was further purified by recrystallization from hot methanol to furnish pale yellow solid, mp 88°-89° C.; HPLC=99%.

Synthesis of o-(2,4-di-tert-Pentylphenoxy)butyramidophenyl Disulfide

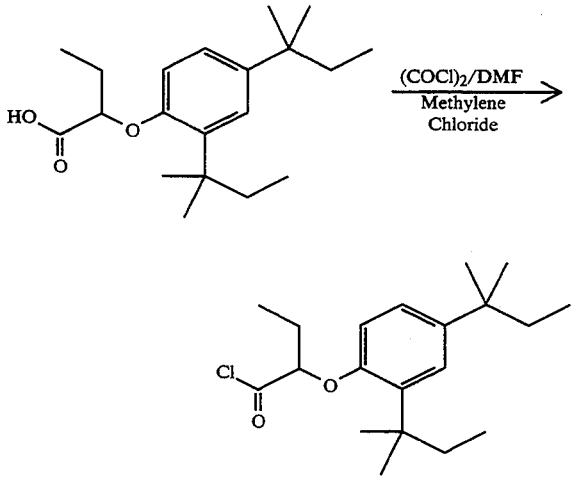

A 1-L round-bottom flask, equipped with a magnetic stirring bar, was charged with 2-(2,4-di-tert-pentylphenoxy)butyric acid (68.8 g, 210 mmol) and 250 mL of dichloromethane. To this well stirred solution of the acid, maintained ca. 25° C. (water-bath), oxalyl chloride (28.5 g, 220 mmol) was added through the dropping funnel. The resulting mixture was cooled (0° C., ice-bath) and N,N-dimethylformamide (DMF, 0.2 mL) was added as the catalyst. The reaction was stirred at 25° C. to completion (monitored by esterification with methanol and TLC analysis in ligroin 950:EtOAc 2:1). Removal of solvents on a rotary evaporator furnished the desired acid chloride as a pale yellow viscous liquid.

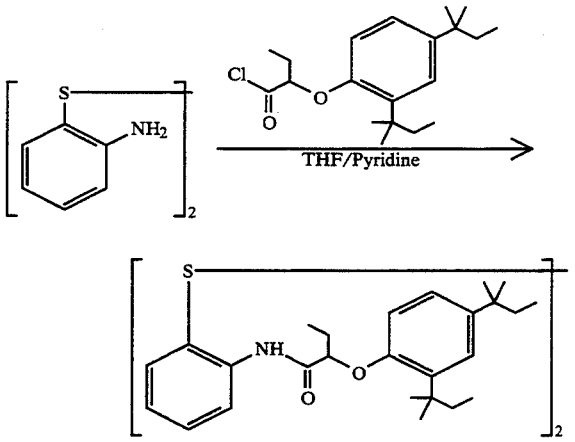

The acid chloride thus synthesized was dissolved in tetrahydrofuran (THF, 100 mL) and added dropwise through a pressure equalized addition funnel to a 1-L flask containing magnetically stirred solution of o-aminophenyl disulfide (24.8 g, 100 mmol) in 200 mL of THF and 75 mL of pyridine. The reaction was monitored to completion by TLC (20 min). The mixture was poured into crushed ice and the precipitate was collected; the crude product o-(2,4-di-tert-pentylphenoxy)-butyramidophenyl disulfide, was further purified by recrystallization from a mixture of acetonitrile and propionitrile to afford 35 g (41% yield) of the desired product. HPLC: 99.1%. Anal Calcd for $C_{52}H_{72}O_4N_2S_2$: C, 73.2; H, 8.5; N, 3.3; S, 7.5. Found: C, 73.2; H, 8.3; N, 2.9; S, 7.0. The $^1H$ NMR spectrum ($CDCl_3$, 300 MHz) was consistent with the structure.

Synthesis Example B: Synthesis of Coupler 1-15.

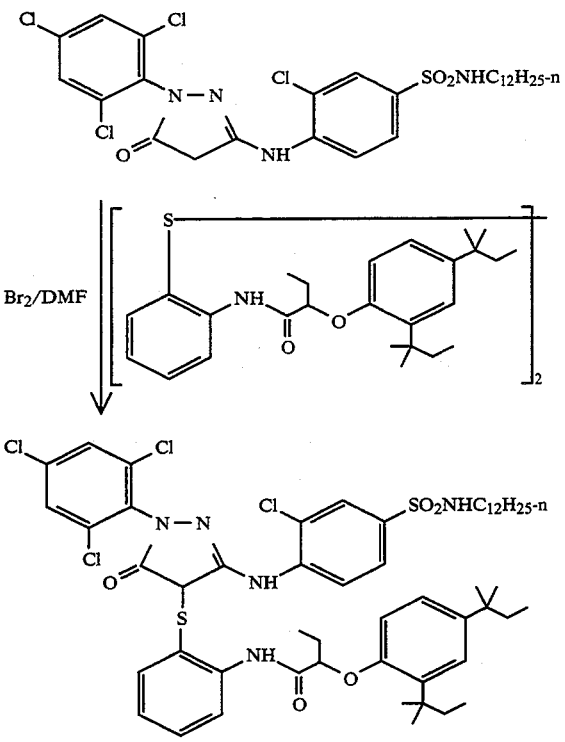

A 250 mL flask equipped with a magnetic stirring bar and a pressure equalizing addition funnel was charged with o-(2,4-di-tert-pentylphenoxy)butyramidophenyl disulfide (14.6 g, 16.4 mmol), pyrazolone coupler (MW 636.5, 20.0 g, 31.4 mmol), and DMF (100 mL). To this well stirred slurry, bromine (0.81 mL, 15.8 mmol) dissolved in DMF (15 mL) was added dropwise through an addition funnel. The resulting mixture was heated to ~60° C., and maintained at that temperature. After 1 h, TLC analysis showed unreacted coupler, so additional $Br_2$ (0.05 mL, 1.0 mmol) was added. After another 0.5 h, the mixture was poured into crushed ice and the resulting product was filtered to afford the desired coupler in quantitative yield. This was further purified by flash chromatography on silica gel [EtOAc/Ligroin (1:10)—2 L, (1:5)—6 L, (1:3)—2 L, (1:2)—2 L, (1:1)—4 L, (3:2)—2 L; 1 L fractions, 10×15 cm column]. Concentration of fractions 8–17 gave 31.3 g of M-11 (94% yield). Alternatively, the crude mixture could be recrystallized from EtOAc/Ligroin (~1:10) to afford pure M-11.

Synthesis Example C: Synthesis of Coupler 1-28

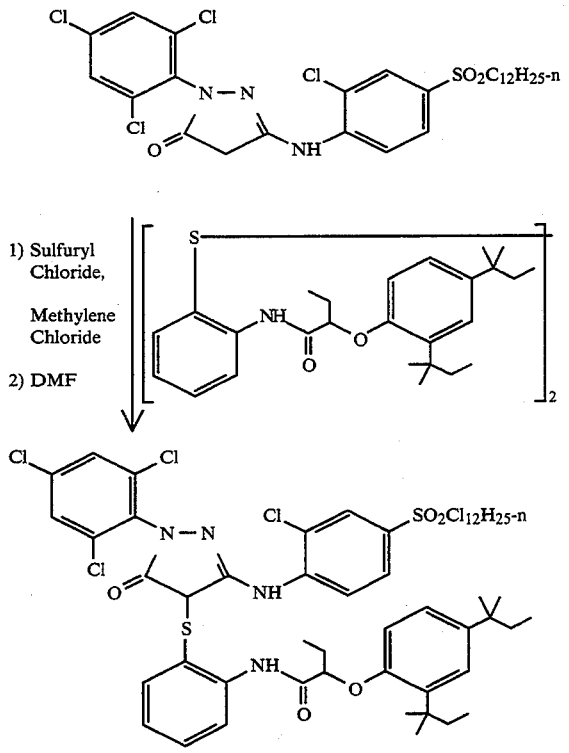

Sulphuryl chloride (5.1 g, 37.5 mmol) was added to a solution of the disulfide (o-(2,4-Di-tertpentylphenoxy)-butyramidophenyl disulfide, 32.0 g, 37.5 mmol), in dichloromethane (150 mL). After 1.75 hr, the volatiles were removed by rotary evaporation below 40° C. A solution of the pyrazolone coupler (MW 621, 45.0 g, 72.5 mmol) in DMF (200 mL) was added rapidly to the oil. After stirring at room temperature for 51 hr, the mixture was poured slowly into 3N HCl (1500 mL). The sticky solid was collected by filtration and the residue was dissolved in ethyl acetate (700 mL). The organic solution was washed with water (2×150 mL), dried and evaporated under reduced pressure. The crude material was purified by column chromatography on silica gel [EtOAc/Ligroin (1:2)]. The resulting oil was dissolved in acetic acid (100 mL) and precipitated by addition to water (4000 mL). The solid was collected by filtration to give I-30 as a white solid (49.0 g, 65%).

Synthesis Example D: Synthesis of Coupler I-31

Synthesis of Coupling-off Group Q-8.

Synthesis of Methyl (3-Pentadecylphenoxy) acetate

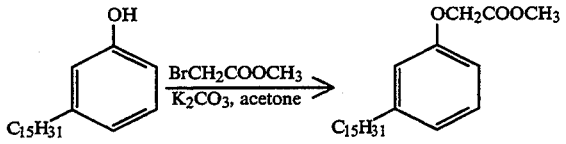

A 1-L three necked flask, equipped with a mechanical stirrer, pressure equalizing addition funnel, and a reflux condenser was charged with 1-L of reagent grade acetone, 3-pentadecylphenol (100 g, 0.328 mol), and anhydrous potassium carbonate (82 g, 0.6 mol). To this well stirred solution, methyl bromoacetate (69 g, 0.7 mol) was added through the addition funnel. The resulting mixture was vigorously stirred and heated to gentle reflux over a heating mantle.. The reaction was monitored by TLC (5:1 ligroin 950 and EtOAc). The reaction was continued overnight to completion and then cooled to room temperature. Potassium carbonate was filtered. After a few minutes of standing, the product precipitated. The volatiles were removed on a rotary evaporator to afford a beige solid. This was further purified by recrystallization from hot methanol to give 108 g (88% yield) of the desired ester, mp 44° C.

Synthesis of (3-Pentadecylphenoxy)acetic Acid

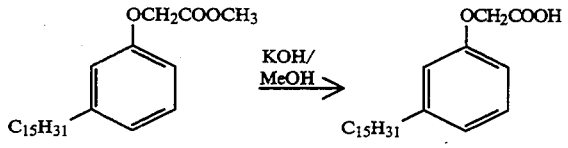

A 2-L round bottom flask equipped with a magnetic stirring bar and a reflux condenser was charged with potassium hydroxide (28 g, 0.5 mol) and methanol (1-L). To this vigorously stirred mixture, methyl (3-pentadecylphenoxy)acetate (93 g, 0.247 mol) was added and the resulting slurry was brought to a gentle reflux (2 hr). The ester was not completely soluble. The reaction was monitored by TLC. The hydrolysis was complete in 2 hr. The mixture was cooled and poured into crushed ice-water-hydrochloric acid mixture to precipitate the acid as white solid. The acid was dried and further purified by trituration from hot methanol to afford 82 g (92% yield) of the acid, mp 96° C.

Synthesis of 2-(3-Pentadecylphenoxyacetamido)phenyl Disulfide, Q-8

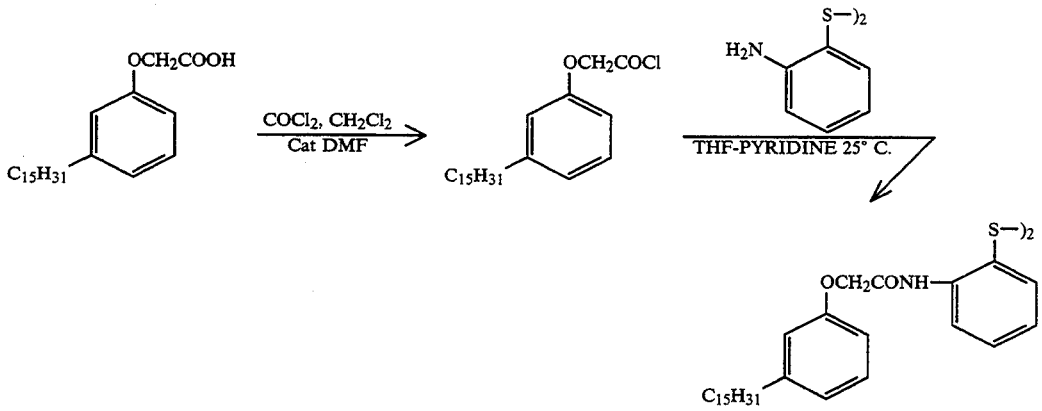

A 500-mL flask, equipped with a magnetic stirring bar was charged with 3-pentadecylphenoxyacetic acid (27.1 g, 75 mmoles) and dichloromethane (200 ml). To this well stirred slurry, oxalyl chloride (10.2 g, 80 mmoles) was added dropwise through an addition funnel. N,N-Dimethylformamide (0.5 ml) was added to serve as the catalyst.

A vigorous gas evolution was observed and the solution became clear in 45 min. The reaction was complete (methanolysis of an aliquot and analysis by TLC in 2:1 ligroin 950: EtOAc) in 2 hr. Removal of volatile solvents on a rotary evaporator furnished the desired acid chloride (28.6 g, 100% yield) as a viscous oil.

A 1-L flask equipped with a magnetic stirring bar and a pressure equalizing dropping funnel was charged with o-aminophenyl disulfide (8 g, 32 mmoles) , tetrahydrofuran (THF, 35 ml), and pyridine (35 ml). To this well stirred solution, previously synthesized acid chloride dissolved in dry THF was added through the addition funnel. The mixture was well stirred and monitored by TLC (ligroin 950:EtOAc, 5:1). The reaction was complete in 1 hr. The mixture was poured into crushed ice-water mixture, stirred well, and the resulting cream colored solid filtered and dried (30 g, ~100% yield). The crude product was further purified by recrystallization from 3:1 mixture of hot n-butyronitrile and acetonitrile to furnish 3-pentadecylphenoxyphenyl disulfide (26 g, 87%) as pale yellow crystals, mp 89°-90° C. Calculated for $C_{58}H_{84}N_2O_4S_2$: C, 74.31; H, 9.03; N, 2.99; S, 6.84. Found: C, 74.56; H, 8.91; N, 2.92; S, 7.18.

Synthesis of Coupler I-31.

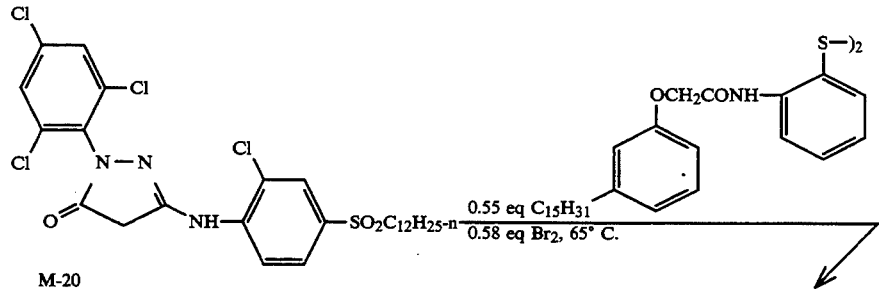

-continued

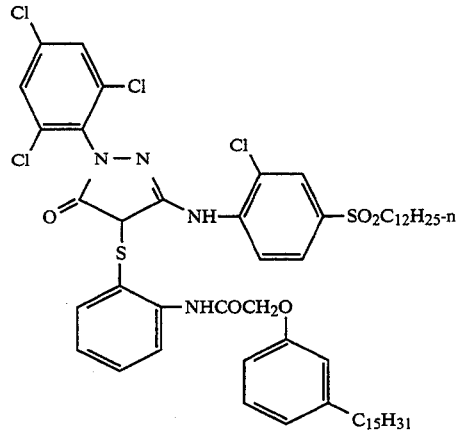

I-31

A 500-mL flask equipped with a magnetic stirring bar and a reflux condenser connected to a mineral oil bubbler was charged with the 4-equivalent pyrazolone magenta coupler (M-20, 9.6 g, 15.5 mmoles, FEW 621) and 3-pentadecylphenoxyphenyl disulfide (9.8 g, 8.5 mmoles), and DMF (70 ml). The disulfide did not dissolve in DMF completely. To this ,bromine (1.5 g, 9.35 mmoles) dissolved in DMF (6 ml) was added. The resulting mixture was heated (60°–70° C.) and the reaction monitored by TLC to completion (2 hr). TLC analysis revealed the reaction to be clean essentially affording a single product. The mixture was cooled to room temperature and poured into a mixture of crushed ice and water. The coupler was extracted with ethyl acetate and the removal of volatile provided a red oil. Addition of a 1:3 mixture of n-butyronitrile and acetonitrile followed by warming and cooling precipitated the coupler as a creamy solid (17 g, 100%, HPLC 97%). This was further recrystallized from hot butyronitrile (13.7 g, 78% yield), mp 98°–99° C. Calculated for $C_{56}H_{74}Cl_4N_4O_5S_2$: C, 61.75; H, 6.84; N, 5.14; Cl,13.02; S, 5.88. Found: C, 61.69; H, 6.78; N, 5.24; Cl,13.0; S, 6.37. FDMS ($M^+$): 1079.

The purity of the two-equivalent couplers synthesized was checked by (a) TLC in two or three different solvent systems of different polarity, (b) HPLC, (c) 300 MHz FT-NMR and (d) elemental analyses (C, H, N, Cl, S); some samples were also subjected to mass spectral analysis.

The following structures are included for comparative purposes:

CM-1

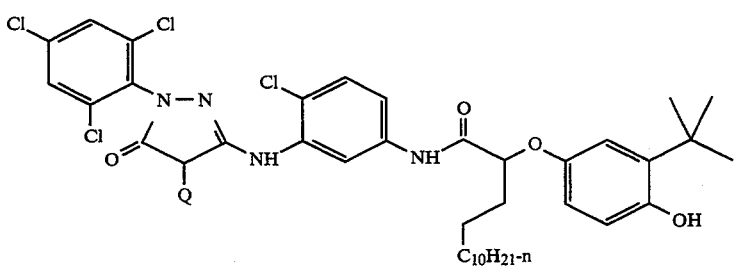

CM-2

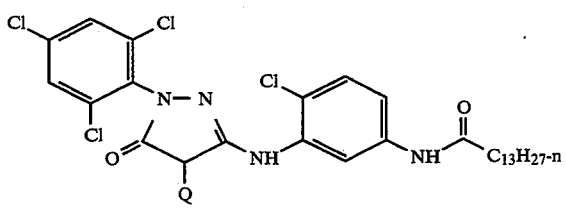

CM-3

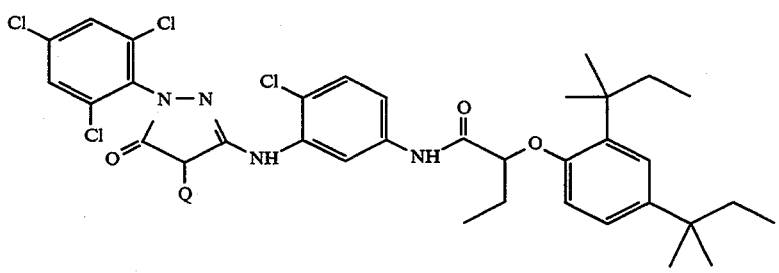

-continued
CM-4
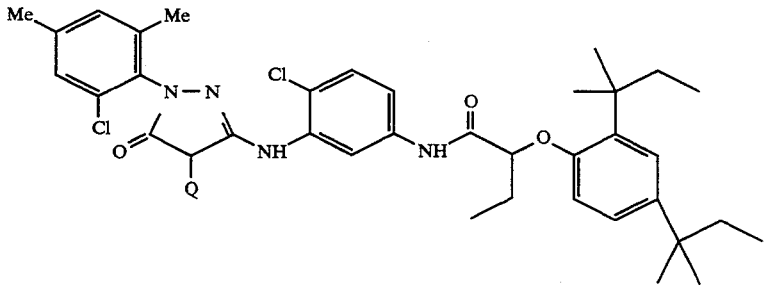
CM-5
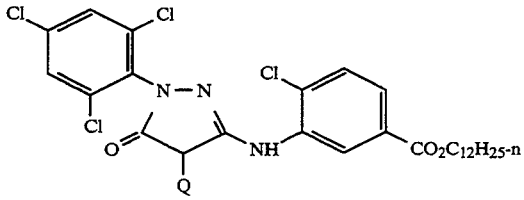
CM-6
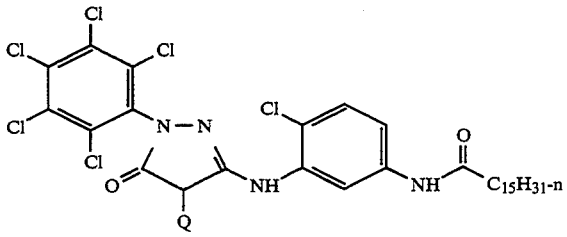
CQ-1
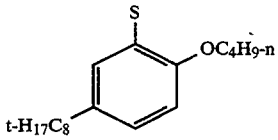
CQ-2
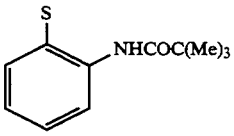
CQ-3
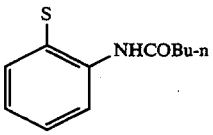
CQ-4
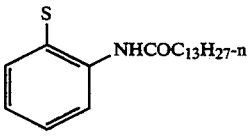
CQ-5
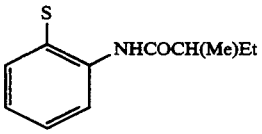
CQ-6
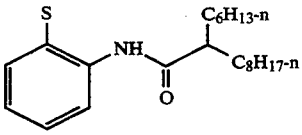

-continued

CQ-7

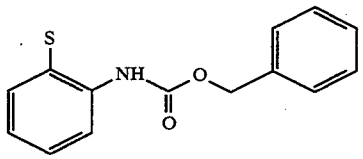

The following compounds were prepared by this general method:

TABLE I

Summary of Batho-shifted 3-Anilino 4-(Arylthio) Pyrazolone Couplers[a, b]

| Coupler | HPLC Purity[c] | | Elemental Analysis C | H | N | Cl | S | mp, °C. | Type | COUP/Q |
|---|---|---|---|---|---|---|---|---|---|---|
| C-1 | na | calc. | na | | | | | 179–180 | Check | CM-1/Q = H |
| | | found | | | | | | | | |
| C-2 | na | calc. | na | | | | | 165–167 | Check | CM-2/CQ-1 |
| | | found | | | | | | | | |
| C-3 | na | calc. | na | | | | | 129–133 | Check | CM-2/CQ-2 |
| | | found | | | | | | | | |
| C-4 | 99.4 | calc. | na | | | | | 86–90 | Check | CM-3/Q-22 |
| | | found | | | | | | | | |
| C-5 | 99.6 | calc. | 63.5 | 6.9 | 6.7 | 13.6 | 3.1 | 201–203 | Check | CM-2/Q-1 |
| | | found | 63.8 | 6.7 | 6.5 | 13.3 | 3.2 | | | |
| C-6 | 95.5 | calc. | na | | | | | glass | Check | CM-4/CQ-2 |
| | | found | | | | | | | | |
| C-7 | 97.0 | calc. | na | | | | | glass | Check | CM-5/Q-1 |
| | | found | | | | | | | | |
| C-8 | na | calc. | na | | | | | na | Check | M-11/CQ-2 |
| | | found | | | | | | | | |
| C-9 | na | calc. | 54.1 | 5.6 | 8.3 | | | 98 | Check | M-11/CQ-3 |
| | | found | 53.7 | 5.5 | 8.2 | | | | | |
| C-10 | na | calc. | 58.2 | 6.7 | 7.2 | | | 112 | Check | M-11/CQ-4 |
| | | found | 58.5 | 6.7 | 7.0 | | | | | |
| C-11 | na | calc. | 54.1 | 5.6 | 8.3 | | | 100 | Check | M-11/CQ-5 |
| | | found | 54.0 | 5.5 | 8.2 | | | | | |
| C-12 | 88.1 | calc. | na | | | | | glass | Check | M-11/CQ-6 |
| | | found | | | | | | | | |
| C-13 | na | calc. | na | | | | | na | Check | CM-2/Q-29 |
| | | found | | | | | | | | |
| C-14 | na | calc. | na | | | | | 163 | Check | CM-6/CQ-7 |
| | | found | | | | | | | | |
| I-1 | 95.8 | calc. | na | | | | | glass | Invention | M-1/Q-1 |
| | | found | | | | | | | | |
| I-2 | 87.2 | calc. | na | | | | | glass | Invention | M-1/Q-4 |
| | | found | | | | | | | | |
| I-3 | 96.8 | calc. | na | | | | | glass | Invention | M-1/Q-6 |
| | | found | | | | | | | | |
| I-4 | 93.9 | calc. | na | | | | | glass | Invention | M-1/Q-2 |
| | | found | | | | | | | | |
| I-5 | 97.9 | calc. | na | | | | | glass | Invention | M-2/Q-1 |
| | | found | | | | | | | | |
| I-6 | 99.9 | calc. | na | | | | | glass | Invention | M-3/Q-1 |
| | | found | | | | | | | | |
| I-7 | 99.7 | calc. | na | | | | | glass | Invention | M-4/Q-1 |
| | | found | | | | | | | | |
| I-8 | na | calc. | 58.6 | 5.9 | 7.0 | 14.1 | | glass | Invention | M-5/Q-1 |
| | | found | 56.8 | 5.6 | 7.1 | 13.6 | | | | |
| I-9 | na | calc. | 58.5 | 6.1 | 7.0 | | | 196–199 | Invention | M-6/Q-1 |
| | | found | 58.5 | 5.9 | 6.9 | | | | | |
| I-10 | 99.7 | calc. | na | | | | | glass | Invention | M-7/Q-1 |
| | | found | | | | | | | | |
| I-11 | 93.0 | calc. | na | | | | | glass | Invention | M-7/Q-15 |
| | | found | | | | | | | | |
| I-12 | na | calc. | 58.6 | 5.9 | 7.0 | 14.1 | | glass | Invention | M-8/Q-1 |
| | | found | 57.3 | 5.7 | 7.0 | 14.6 | | | | |
| I-13 | 99.8 | clac. | na | | | | | glass | Invention | M-9/Q-1 |
| | | found | | | | | | | | |
| I-14 | 86.6 | calc. | na | | | | | glass | Invention | M-10/Q-1 |
| | | found | | | | | | | | |
| I-15 | 96.9 | calc. | na | | | | | glass | Invention | M-11/Q-1 |
| | | found | | | | | | | | |
| I-16 | 96.4 | calc. | na | | | | | glass | Invention | M-11/Q-4 |
| | | found | | | | | | | | |
| I-17 | 94.8 | calc. | na | | | | | glass | Invention | M-11/Q-6 |
| | | found | | | | | | | | |
| I-18 | na | calc. | 59.2 | 6.3 | 6.8 | | | 107 | Invention | M-11/Q-9 |
| | | found | 59.8 | 6.3 | 6.8 | | | | | |

TABLE I-continued

| Coupler | HPLC Purity[c] | Summary of Batho-shifted 3-Anilino 4-(Arylthio) Pyrazolone Couplers[a, b] | Elemental Analysis C | H | N | Cl | S | mp, °C. | Type | COUP/Q |
|---|---|---|---|---|---|---|---|---|---|---|
| I-19 | 99.6 | calc. | na | | | | | glass | Invention | M-11/Q-2 |
| | | found | | | | | | | | |
| I-20 | 72.0 | calc. | | | | | | glass | Invention | M-11/Q-15 |
| | | found | | | | | | | | |
| I-21 | 98.5 | calc. | na | | | | | glass | Invention | M-11/Q-21 |
| | | found | | | | | | | | |
| I-22 | 96.0 | calc. | na | | | | | glass | Invention | M-11/Q-22 |
| | | found | | | | | | | | |
| I-23 | 97.4 | calc. | na | | | | | glass | Invention | M-13/Q-1 |
| | | found | | | | | | | | |
| I-24 | 97.6 | calc. | na | | | | | glass | Invention | M-15/Q-1 |
| | | found | | | | | | | | |
| I-25 | na | calc. | 58.1 | 6.3 | 6.4 | | | glass | Invention | M-17/Q-1 |
| | | found | 57.7 | 6.2 | 6.2 | | | | | |
| I-26 | na | calc. | 55.7 | 4.8 | 6.3 | | | glass | Invention | M-18/Q-1 |
| | | found | 56.2 | 5.0 | 6.1 | | | | | |
| I-27 | 92.6 | calc. | na | | | | | glass | Invention | M-19/Q-1 |
| | | found | | | | | | | | |
| I-28 | 94.3 | calc. | 60.8 | 6.6 | 5.3 | 13.5 | 6.1 | glass | Invention | M-20/Q-1 |
| | | found | 60.5 | 6.5 | 5.2 | 13.3 | 5.9 | | | |
| I-29 | | calc. | na | | | | | glass | Invention | M-1/Q-29 |
| | | found | | | | | | | | |
| I-30 | | calc | na | | | | | glass | Invention | M-20/Q-29 |
| | | found | | | | | | | | |
| I-31 | | calc | 61.8 | 6.8 | 5.1 | 13.0 | 5.9 | 98–99 | Invention | M-20/Q-8 |
| | | found | 61.6 | 6.8 | 5.2 | 13.0 | 6.4 | | | |
| I-32 | | | | | | | | 134–126 | Invention | M-20/Q-47 |
| I-33 | | calc | 59.4 | 6.1 | 5.7 | 14.3 | | 109–111 | Invention | M-20/Q-11 |
| | | found | 58.6 | 6.2 | 5.5 | 14.0 | | | | |
| I-34 | | | | | | | | 258 | Invention | M-20/Q-48 |
| I-35 | 94.9 | | | | | | | glass | Invention | M-20/Q-2 |

[a]All new couplers exhibited satisfactory $^1$H NMR (FT-300 MHz).
[b]Couplers were homogeneous in solvent systems of different polarity.
[c]The values represent minimum since some decomposition is observed with some couplers on HPLC although other analytical tools indicate them to be >95% pure.
[d]This information is not available.

TABLE II

| Coupler | $X_1$ σ | $X_1$ π | $X_2$ σ | $X_2$ π | Y σ | Y π | $G_1$ σ | $G_1$ π | $G_2$ σ | $G_2$ π | Σ Parent σ | Σ Parent π | Σ Z + $R_1$ π |
|---|---|---|---|---|---|---|---|---|---|---|---|---|---|
| | Substituent Constant Values[a,b] | | | | | | | | | | | | |
| C-1 | 0.23 | 0.71 | 0.23 | 0.71 | 0.23 | 0.71 | 0.23 | 0.71 | 0.21 | 8.46 | 1.13 | 11.30 | 0.00 |
| C-2 | 0.23 | 0.71 | 0.23 | 0.71 | 0.23 | 0.71 | 0.23 | 0.71 | 0.21 | 7.81 | 1.13 | 10.65 | 1.55 |
| C-3 | 0.23 | 0.71 | 0.23 | 0.71 | 0.23 | 0.71 | 0.23 | 0.71 | 0.21 | 7.81 | 1.13 | 10.65 | 0.26 |
| C-4 | 0.23 | 0.71 | 0.23 | 0.71 | 0.23 | 0.71 | 0.23 | 0.71 | 0.21 | 6.08 | 1.13 | 8.92 | 9.06 |
| C-5 | 0.23 | 0.71 | 0.23 | 0.71 | 0.23 | 0.71 | 0.23 | 0.71 | 0.21 | 7.81 | 1.13 | 10.65 | 6.08 |
| C-6 | −0.17 | 0.56 | 0.23 | 0.71 | 0.23 | 0.71 | −0.17 | 0.56 | 0.21 | 6.08 | 0.33 | 8.62 | 0.26 |
| C-7 | 0.23 | 0.71 | 0.23 | 0.71 | 0.23 | 0.71 | 0.23 | 0.71 | 0.37 | 6.53 | 1.29 | 9.37 | 6.08 |
| C-8 | 0.23 | 0.71 | 0.23 | 0.71 | 0.23 | 0.71 | 0.23 | 0.71 | 0.57 | 4.60 | 1.49 | 7.44 | 0.26 |
| C-9 | 0.23 | 0.71 | 0.23 | 0.71 | 0.23 | 0.71 | 0.23 | 0.71 | 0.57 | 4.60 | 1.49 | 7.44 | 0.61 |
| C-10 | 0.23 | 0.71 | 0.23 | 0.71 | 0.23 | 0.71 | 0.23 | 0.71 | 0.57 | 4.60 | 1.49 | 7.44 | 5.37 |
| C-11 | 0.23 | 0.71 | 0.23 | 0.71 | 0.23 | 0.71 | 0.23 | 0.71 | 0.57 | 4.60 | 1.49 | 7.44 | 0.39 |
| C-12 | 0.23 | 0.71 | 0.23 | 0.71 | 0.23 | 0.71 | 0.23 | 0.71 | 0.57 | 4.60 | 1.49 | 7.44 | 6.21 |
| C-13 | 0.23 | 0.71 | 0.23 | 0.71 | 0.23 | 0.71 | 0.23 | 0.71 | 0.21 | 7.81 | 1.13 | 10.65 | 3.75 |
| C-14 | 0.23 | 0.71 | 0.23 | 0.71 | 0.23 | 0.71 | 0.23 | 0.71 | 0.21 | 6.43 | 1.59 | 10.69 | 1.39 |
| I-1 | 0.23 | 0.71 | 0.23 | 0.71 | 0.23 | 0.71 | 0.23 | 0.71 | 0.57 | −0.38 | 1.49 | 2.46 | 6.08 |
| I-2 | 0.23 | 0.71 | 0.23 | 0.71 | 0.23 | 0.71 | 0.23 | 0.71 | 0.57 | −0.38 | 1.49 | 2.46 | 8.12 |
| I-3 | 0.23 | 0.71 | 0.23 | 0.71 | 0.23 | 0.71 | 0.23 | 0.71 | 0.57 | −0.38 | 1.49 | 2.46 | 11.37 |
| I-4 | 0.23 | 0.71 | 0.23 | 0.71 | 0.23 | 0.71 | 0.23 | 0.71 | 0.57 | −0.38 | 1.49 | 2.46 | 9.28 |
| I-5 | 0.23 | 0.71 | 0.23 | 0.71 | 0.23 | 0.71 | 0.23 | 0.71 | 0.57 | 0.25 | 1.49 | 3.09 | 6.08 |
| I-6 | 0.23 | 0.71 | 0.23 | 0.71 | 0.23 | 0.71 | 0.23 | 0.71 | 0.57 | 2.35 | 1.49 | 5.19 | 6.08 |
| I-7 | 0.23 | 0.71 | 0.23 | 0.71 | 0.23 | 0.71 | 0.23 | 0.71 | 0.57 | 2.26 | 1.49 | 5.10 | 6.08 |
| I-8 | 0.23 | 0.71 | 0.23 | 0.71 | 0.23 | 0.71 | 0.23 | 0.71 | 0.57 | 2.48 | 1.49 | 5.32 | 6.08 |
| I-9 | 0.23 | 0.71 | 0.23 | 0.71 | 0.23 | 0.71 | 0.23 | 0.71 | 0.57 | 1.87 | 1.49 | 4.71 | 6.08 |
| I-10 | 0.23 | 0.71 | 0.23 | 0.71 | 0.23 | 0,71 | 0.23 | 0.71 | 0.57 | 2.37 | 1.49 | 5.21 | 6.08 |
| I-11 | 0.23 | 0.71 | 0.23 | 0.71 | 0.23 | 0.71 | 0.23 | 0.71 | 0.57 | 2.37 | 1.49 | 5.21 | 9.80 |
| I-12 | 0.23 | 0.71 | 0.23 | 0.71 | 0.23 | 0.71 | 0.23 | 0.71 | 0.57 | 2.11 | 1.49 | 4.95 | 6.08 |
| I-13 | 0.23 | 0.71 | 0.23 | 0.71 | 0.23 | 0.71 | 0.23 | 0.71 | 0.57 | 1.93 | 1.49 | 4.77 | 6.08 |
| I-14 | 0.23 | 0.71 | 0.23 | 0.71 | 0.23 | 0.71 | 0.23 | 0.71 | 0.57 | 4.49 | 1.49 | 7.33 | 6.08 |
| I-15 | 0.23 | 0.71 | 0.23 | 0.71 | 0.23 | 0.71 | 0.23 | 0.71 | 0.57 | 4.60 | 1.49 | 7.44 | 6.08 |
| I-16 | 0.23 | 0.71 | 0.23 | 0.71 | 0.23 | 0.71 | 0.23 | 0.71 | 0.57 | 4.60 | 1.49 | 7.44 | 5.37 |
| I-17 | 0.23 | 0.71 | 0.23 | 0.71 | 0.23 | 0.71 | 0.23 | 0.71 | 0.57 | 4.60 | 1.49 | 7.44 | 11.37 |
| I-18 | 0.23 | 0.71 | 0.23 | 0.71 | 0.23 | 0.71 | 0.23 | 0.71 | 0.57 | 4.60 | 1.49 | 7.44 | 5.25 |
| I-19 | 0.23 | 0.71 | 0.23 | 0.71 | 0.23 | 0.71 | 0.23 | 0.71 | 0.57 | 4.60 | 1.49 | 7.44 | 9.28 |
| I-20 | 0.23 | 0.71 | 0.23 | 0.71 | 0.23 | 0.71 | 0.23 | 0.71 | 0.57 | 4.60 | 1.49 | 7.44 | 9.80 |

TABLE II-continued

| | Substituent Constant Values[a,b] | | | | | | | | | | | | |
|---|---|---|---|---|---|---|---|---|---|---|---|---|---|
| | $X_1$ | | $X_2$ | | Y | | $G_1$ | | $G_2$ | | Σ Parent | | Σ Z + $R_1$ |
| Coupler | σ | π | σ | π | σ | π | σ | π | σ | π | σ | π | π |
| I-21 | 0.23 | 0.71 | 0.23 | 0.71 | 0.23 | 0.71 | 0.23 | 0.71 | 0.57 | 4.60 | 1.49 | 7.44 | 4.81 |
| I-22 | 0.23 | 0.71 | 0.23 | 0.71 | 0.23 | 0.71 | 0.23 | 0.71 | 0.57 | 4.60 | 1.49 | 7.44 | 9.06 |
| I-23 | 0.23 | 0.71 | 0.23 | 0.71 | 0.23 | 0.71 | 0.23 | 0.71 | 0.45 | 6.53 | 1.37 | 9.37 | 6.08 |
| I-24 | 0.23 | 0.71 | 0.23 | 0.71 | 0.23 | 0.71 | 0.23 | 0.71 | 0.36 | 4.54 | 1.35 | 7.38 | 6.08 |
| I-25 | 0.23 | 0.71 | 0.23 | 0.71 | 0.23 | 0.71 | 0.23 | 0,71 | 0.69 | 5.82 | 1.61 | 8.66 | 6.08 |
| I-26 | 0.23 | 0.71 | 0.23 | 0.71 | 0.23 | 0.71 | 0.23 | 0.71 | 0.60 | 1.42 | 1.52 | 4.26 | 6.08 |
| I-27 | 0.23 | 0.71 | 0.23 | 0.71 | 0.23 | 0.71 | 0.23 | 0.71 | 0.60 | 7.24 | 1.52 | 10.08 | 6.08 |
| I-28 | 0.23 | 0.71 | 0.23 | 0.71 | 0.23 | 0.71 | 0.23 | 0.71 | 0.78 | 4.18 | 1.64 | 7.02 | 6.08 |
| I-29 | 0.23 | 0.71 | 0.23 | 0.71 | 0.23 | 0.71 | 0.23 | 0.71 | 0.57 | 4.60 | 1.49 | 7.44 | 3.75 |
| I-30 | 0.23 | 0.71 | 0.23 | 0.71 | 0.23 | 0.71 | 0.23 | 0.71 | 0.78 | 4.18 | 1.64 | 7.02 | 3.75 |
| I-31 | 0.23 | 0.71 | 0.23 | 0.71 | 0.23 | 0.71 | 0.23 | 0.71 | 0.78 | 4.18 | 1.64 | 7.02 | 7.84 |
| I-32 | 0.23 | 0.71 | 0.23 | 0.71 | 0.23 | 0.71 | 0.23 | 0.71 | 0.78 | 4.18 | 1.64 | 7.02 | 2.61 |
| I-33 | 0.23 | 0.71 | 0.23 | 0.71 | 0.23 | 0.71 | 0.23 | 0.71 | 0.78 | 4.18 | 1.64 | 7.02 | 3.69 |
| I-34 | 0.23 | 0.71 | 0.23 | 0.71 | 0.23 | 0.71 | 0.23 | 0.71 | 0.78 | 4.18 | 1.64 | 7.02 | 10.10 |
| I-35 | 0.23 | 0.71 | 0.23 | 0.71 | 0.23 | 0.71 | 0.23 | 0.71 | 0.78 | 4.18 | 1.64 | 7.02 | 9.06 |

[a]Values for sigma and pi were found in published chemical literature (see for example "The Chemist Companion", A. J. Gordon and R. A. Ford, John Wiley & Sons, New York, 1972; "Progress in Physical Organic Chemistry, Volume 13", R. W. Taft, Ed., John Wiley & Sons, New York; and C. Hansch and A. J. Leo, in "Substituent Constants for Correlation Analysis in Chemistry and Biology", Wiley, New York, 1979), or pi values were calculated using the Medchem program (for a recent discussion of this method see Albert J. Leo, in "Comprehensive Medicinal Chemistry", edited by C. Hansch, P. G. Sammes, and J. B. Taylor, Pergamon Press, New York, Volume 4, 1990). The values for $sigma_{para}$ were used to estimate the value for substituents ortho to the pyrazolone nucleus. Σ Parent is the sum of the values of the substituent constants $X_1$, $X_2$, Y, $G_1$, and $G_2$.

Typically, the coupler is incorporated in a silver halide emulsion and the emulsion coated on a support to form part of a photographic element. Alternatively, the coupler can be incorporated at a location adjacent to the silver halide emulsion where, during development, the coupler will be in reactive association with development products such as oxidized color developing agent. Thus, as used herein, the term "associated therewith" signifies that the coupler is in the silver halide emulsion layer or in an adjacent location where, during processing, the coupler is capable of reacting with silver halide development products.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a coupler of this invention. The element can contain additional layers, such as filter layers, interlayers, overcoat layers, subbing layers, and the like.

In the following discussion of suitable materials for use in the emulsions and elements of this invention, reference will be made to Research Disclosure, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylene diamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative working silver halide a negative image can be formed. Optionally positive (or reversal) image can be formed.

The magenta coupler described herein may be used in combination with other classes of magenta image couplers such as 3-acylamino-5-pyrazolones and heterocyclic couplers (e.g. pyrazoloazoles) such as those described in EP 285,274; U.S. Pat. No. 4,540,654; EP 119,860, or with other 5-pyrazolone couplers containing different ballasts or coupling-off groups such as those described in U.S. Pat. Nos. 4,301,235; 4,853,319 and 4,351,897. The coupler may also be used in association with yellow or cyan colored couplers (e.g. to adjust levels of interlayer correction) and with masking couplers such as those described in EP 213,490; Japanese Published Application 58-172,647; U.S. Pat. NO. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The coupler may also be used in association with materials that accelerate or otherwise modify the processing steps e.g. of bleaching or fixing to improve the quality of the image. Bleach accelerators described in EP 193,389; EP 301,477; U.S. Pat. Nos. 4,163,669; 4,865,956; and 4,923,784 are particularly useful. Also contemplated is use of the coupler in association with nucleating agents, development accelerators or their precursors (UK Patent 2,097,140; U.K. Patent 2,131,188); electron transfer agents (U.S. Pat Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers. Suitable hydroquinone color fog inhibitors include, but are not limited to compounds disclosed in EP 69,070; EP 98,241; EP 265,808; Japanese Published Patent Applications 61/233,744; 62/178,250; and 62/178,257. In addition, specifically contemplated are 1,4-benzenedipentanoic acid, 2,5-dihydroxy-Δ, Δ,Δ',Δ'-tetramethyl-, dihexyl ester; 1,4-Benzenedipentanoic acid, 2-hydroxy-5-methoxy-Δ, Δ,Δ', Δ'-tetramethyl-, dihexyl ester; and 2,5- dimethoxy-Δ, Δ, Δ', Δ'-tetramethyl-, dihexyl ester. In addition, it is contemplated that materials of this invention may be used with so called liquid ultraviolet absorbers such as described in U.S. Pat Nos. 4,992,358; 4,975,360; and 4,587,346.

Various kinds of discoloration inhibitors can be used with materials of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato)nickel complex can be employed as a discoloration inhibitor. Specific examples of the organic discoloration inhibitors are described below. For instance, those of hydroquinones are disclosed in U.S. Pat Nos. 2,360,290; 2,418,613; 2,700,453; 2,701,197; 2,710,801; 2,816,028; 2,728,659; 2,732,300; 2,735,765; 3,982,944 and 4,430,425; and British Patent 1,363,921; and so on; 6-hydroxychromans, 5-hydroxycoumarans, spirochromans are disclosed in U.S. Pt. Nos. 3,432,300; 3,573,050; 3,574,627; 3,698,909 and 3,764,337; and Japanese Published Patent Application 52-152,225; and so on; spiroindanes are disclosed in U.S. Pat. No. 4,360,589; those of p-alkoxyphenols are disclosed in U.S. Pat No. 2,735,765; British Patent 2,066,975; Japanese Published Patent Applications 59-010,539 and 57-019,765; and so on; hindered phenols are disclosed, for example, in U.S. Pat Nos. 3,700,455; 4,228,235; Japanese Published Patent Applications 52-072,224 and 52-006,623; and so on; gallic acid derivatives, methylenedioxybenzenes and aminophenols are disclosed in U.S. Pat Nos. 3,457,079; 4,332,886; and Japanese Published Patent Applicati 56-021,144, respectively; hindered amines are disclosed U.S. Pat Nos. 3,336,335; 4,268,593; British Patents 1,326,889; 1,354,313 and 1,410,846; Japanese Published Patent Applications 51-001,420; 58-114,036; 59-053,846; 59-078,344; and so on; those of ether or ester derivatives of phenolic hydroxy groups are disclosed in U.S. Pat Nos. 4,155,765; 4,174,220; 4,254,216; 4,279,990; Japanese Published Patent Applications 54-145,530; 55006,321; 58-105,147; 59-010,539; 57-037,856; 53-003,263 and so on; and those of metal complexes are disclosed in U.S. Pat. Nos. 4,050,938 and 4,241,155.

For example, the coupler of the invention may be used to replace all or part of the image coupler or may be added to one or more of the other layers in a color negative photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3 ((2-(4-ethoxy-2,5-dioxo-3-(phenylmethyl)-1 -imidazolidinyl)-3-(4-methoxyphenyl)-1,3 -dioxopropyl) amino)-, dodecyl ester and a slow yellow layer containing the same compound together with "Coupler 2": Propanoic acid, 2-[[5-[[4-[2-[[[2,4-bis (1,1-dimethylpropyl)phenoxy]acetyl]amino]-5-[(2,2,3,3,4,4,4-heptafluoro-1-oxobutyl) amino]-4-hydroxyphenoxy]-2,3 -dihydroxy-6-[(propylamino) carbonyl]phenyl]thio]-1,3,4-thiadiazol-2-yl]thio]-, methyl ester and "Coupler 3": 1- ((dodecyloxy) carbonyl) ethyl (3-chloro-4-( (3-(2-chloro-4-((1-tridecanoylethoxy) carbonyl) anilino)-3-oxo-2-((4) (5) (6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4 -bis (1,1-dimethylpropyl)phenoxy)- 1-oxobutyl)amino)-N(4,5-dihydro-5-oxo-1-(2,4,6-trichlorophenyl)-1H-pyrazol-3-yl)-, "Coupler 5": Benzamide, 3-((2-(2,4-bis (1,1-dimethylpropyl) phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl) amino)carbonyl)-5-hydroxy-1-naphthalenyl)- 2-methylpropyl ester, "Coupler 7": Acetic acid, ((2-((3-(((3-(dodecyloxy)propyl)amino) carbonyl)-4-hydroxy-8-(((2-methylpropoxy)carbonyl) amino)-1-naphthalenyl)oxy)ethyl)thio) -, and "Coupler 8" Benzamide, 3-((2-(2,4-bis (1,1-dimethylpropyl) phenoxy) -1-oxobutyl)amino)-N-(4,5-dihydro-4-((4methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6trichlorophenyl)-4,5-dihydro-5-oxo-1H-pyrazol-3-yl]-2 -methyl-2-propenamide; and "Coupler 10": Tetradecanamide, N-(4-chloro-3-((4-((4-((2,2-dimethyl- 1-oxopropyl) amino)-phenyl)azo)-4,5-dihydro-5-oxo-1(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, the coupler of the invention may suitably be used to replace all or a part of the image coupler or added to a layer in a photographic element such as one comprising a support bearing the following from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide,2-(2,4-bis(1,1-dimethylpropyl)phenoxy)-N-(b 3,5-dichloro-2-hydroxy-4-, and UV Stabilizers: Phenol, 2-(5-chloro-2H-benzotriazol-2-yl)-4,6-bis(1,1-dimethylethyl)-: Phenol, 2-(2H-benzotriazol-2-yl)-4-(1,1-dimethylethyl)-;Phenol, 2-(2H-benzotriazol-2-yl)4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1-dimethulpropyl) phenoxy)-1-oxobutyl)amino)-2-chlorophenyl)-.alpha.-(2,2-dimethyl-1-oxopropyl)-4-ethoxy-2,5-dioxo-3-(phenylmethyl)-.

In a reversal medium, the coupler of the invention could be used to replace all or part of the image coupler or added to a layer in a photographic element such as one comprising a support and bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)phenoxy)acetyl)amino)-N-(4,5-dihydro- 5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl) amino)-3-hydroxyphenyl)-; a mid cyan containing"Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydrozyphenyl)-;

(10) one or more interlayers possibly including fine-grained nonsensitized silver halide; and

(11) an antihalation layer.

The couplers of the invention are useful with gelatin hardeners known to the art, such as 1,2-bis (vinylsulfonyl-acetamido)ethane, 2,4-dichloro-6-hydroxy-s-triazine, triacryloyltriazine, and pyridinium, 1-(4-morpholinylcarbonyl)-4-(2-sulfoethyl)-hydroxide, inner salt. Further, it is contemplated that the couplers of the invention would be particularly useful with so-called rapid acting hardeners, such as described in U.S. Pat. No. 4,877,724 and allowed application U.S. Ser. No. 07/770,393.

The couplers may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pats. No. 4,420,556; and 4,543,323). Also, the couplers may be blocked or coated in protected form as described, for example, in Japanese Application 61/258,249 or U.S. Pat. No.5,019,492.

The coupler may further be used in combination with image-modifying compounds such as "Developer Inhibitor-Releasing" compounds (DIR's). DIR's useful in conjunction with the couplers of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

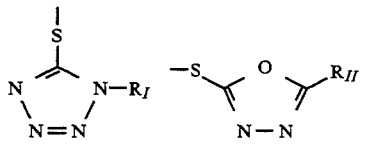

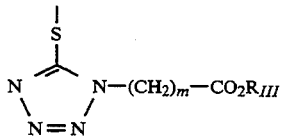

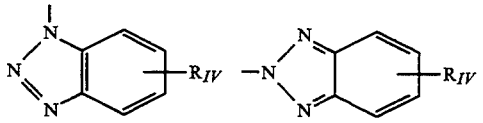

wherein $R_I$ is selected from the group consisting of straight and branched alkyls of from 1 to about 8 carbon atoms, benzyl and phenyl groups and said groups containing at least one alkoxy substituent; $R_{II}$ is selected from $R_I$ and $—SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $—COOR_V$ and $—NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No.4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

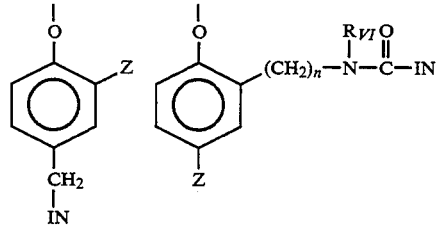

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

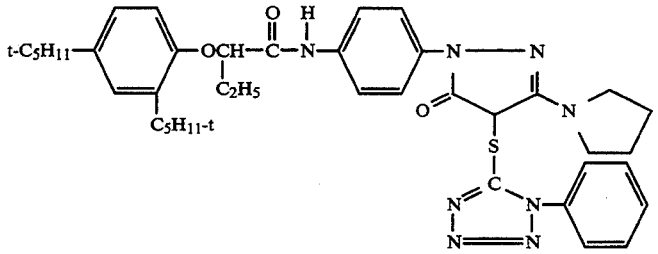

-continued
D2
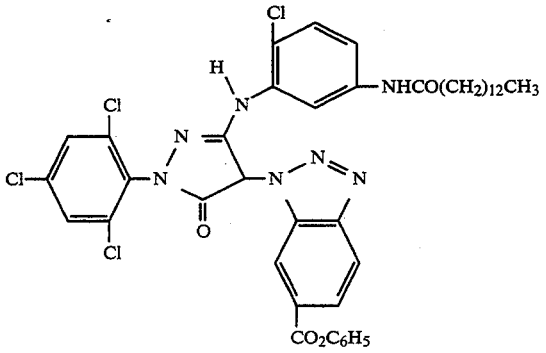
D3
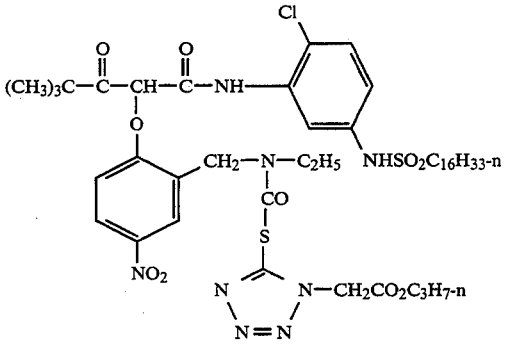
D4
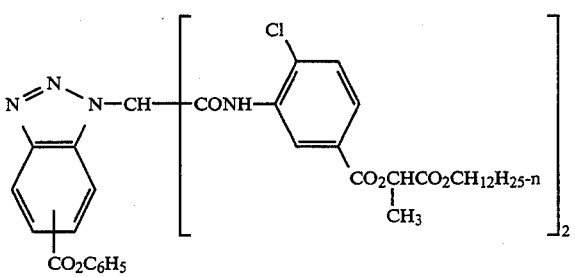
D5
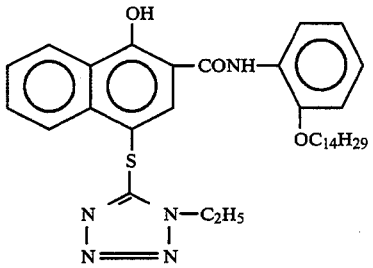
D6
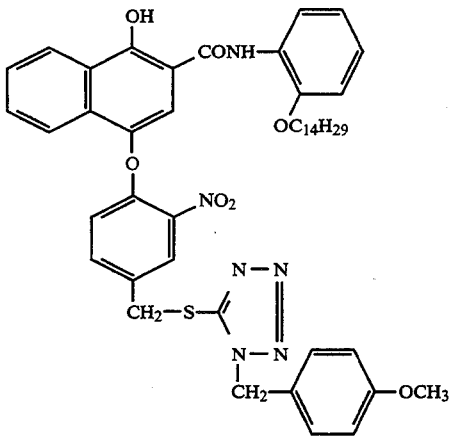

-continued

D7

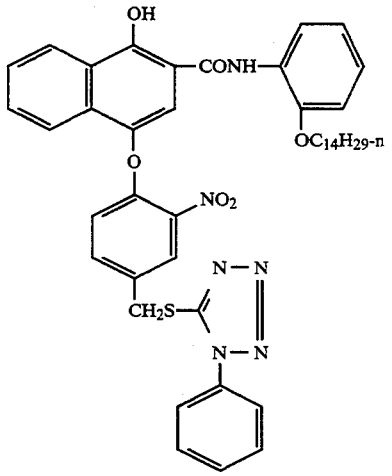

D8

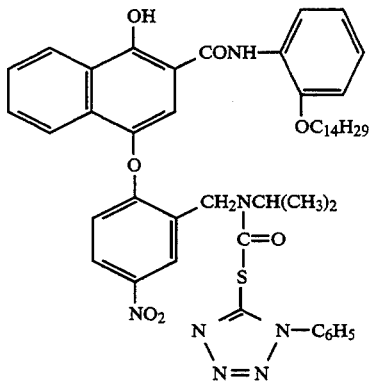

It is also contemplated that the concepts of the present invention may be employed to obtain reflection color prints as described in *Research Disclosure*, Nov. 1979, Item 18716, available from Kenneth Mason Publications, Ltd, Dudley Annex, 12*a* North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications 90-072,629, 90-072,630; 90-072,631; 90-072,632; 90-072,633; 90-072,634; 90077,822; 90-078,229; 90-078,230; 90-079,336; 90079,337; 90-079,338; 90-079,690; 90-079,691; 90080,487; 90-080,488; 90-080,489; 90-080,490; 90 080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

If desired, the photographic element can be used in conjunction with an applied magnetic layer as described in *Research Disclosure*, Nov. 1992, Item 34390 published by Kenneth Mason Publications, Ltd., Dudley Annex, 12*a* North Street, Emsworth, Hampshire P010 7DQ, ENGLAND. Thus, materials of the invention may be employed in conjunction with a photographic material where a relatively transparent film containing magnetic particles is incorporated into the material. The materials of this invention function well in such a combination and give excellent photographic results. Examples of such magnetic films are well known and are described for example in U.S. Patent 4,990,276 and EP 459,349 which are incorporated herein by reference.

As disclosed in these publications, the particles can be of any type available such as ferro- and ferri-magnetic oxides, complex oxides with other metals, ferrites etc. and can assume known particulate shapes and sizes, may contain dopants, and may exhibit the pH values known in the art. The particles may be shell coated and may be applied over the range of typical laydown.

The embodiment is not limited with respect to binders, hardeners, antistatic agents, dispersing agents, plasticizers, lubricants and other known additives.

The couplers of the invention are especially suited for use in combination with these magnetic layers. The layer may suitably be located on the side of the photographic material substrate opposite to the silver halide emulsions and may be employed to magnetically record any desired information. One notable deficiency attributed to such a layer is that the particle layer tends to absorb blue light when light is shined through the processed negative to create a reflective color print. This distorts the color otherwise obtainable without the layer unless needed corrections are made. This also reduces the light transmission during printing so that the printing time must be increased for comparable results. In one embodiment of the invention, the coupler of the present invention may be incorporated in the magenta dye forming layer to replace all or part of the conventional coupler since the invention coupler contains less unwanted blue absorption and can therefore help counteract the undesirable impact of the magnetic layer. Also, if a yellow colored magenta mask is employed, the amount of the mask may be diminished. On the other hand, if all or a portion of the blue absorption can be tolerated, considering the reduction achieved by the invention, then additional amounts of photographically useful groups which generate dye with blue absorbance, such as development inhibitors, can be added to improve sharpness, color and other important photographic properties.

Especially useful in this invention are tabular grain silver halide emulsions. Specifically contemplated tabular grain emulsions are those in which greater than 50 percent of the total projected area of the emulsion grains are accounted for in the case of silver bromide or silver bromoiodide by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfiedby thin ($t<0.2$ micrometers) tabular grains. To achieve the lowest levels of granularity it is preferred that aim tabular grain projected areas be satisfied with ultrathin ($t<0.06$ micrometers) tabular grains. Tabular grain thicknesses typically range down to about 0.02 micrometers. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micronmeters. Ultrathin tabular grain high chloride emulsions are disclosed by Maskasky U.S. Ser. No. 763,030 filed Sep. 20. 1991, now allowed.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, Jan. 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069,5,061,616, 5,210,013 and PCT Ser. No. 93/06521, published Apr. 1, 1993.

The following examples are included for a further understanding of this invention.

Coating Method 1 (4-Equivalent Couplers)

Photographic elements were prepared by coating a gel-subbed, polyethylene-coated paper support with a photosensitive layer containing a silver chloride emulsion at 0.2865 g Ag/m$^2$ for the 4-equivalent coupler (C-1). Gelatin was coated at 1.238 g/m$^2$ and C-1 was coated at 0.549 mmol/m$^2$. Comparison coupler C-1 was dispersed with the following addenda (weight percent of coupler): dibutyl phthalate (50%), Addendum-1 (42.6%), Addendum-2 (10%). The photosensitive layer was overcoated with a protective layer containing gelatin at 1.08 g/m$^2$ and bisvinylsulfonylmethyl ether hardener at 2 weight percent based on total gelatin.

Coating Method 2 (2-Equivalent Couplers)

Photographic elements were prepared by coating a gel-subbed, polyethylene-coated paper support with a photosensitive layer containing a silver chloride emulsion at 0.172 g Ag/m$^2$, gelatin at 1.238 g/m$^2$, and a magenta image coupler indicated below at 0.38 mmol/m$^2$ dispersed in the following addenda (weight percent of coupler): tricresyl phosphate (108%), Addendum-2 (10%), Addendum-3 (115%) and ethyl acetate layer containing gelatin at 1.08 g/m$^2$ and bisvinylsulfonylmethyl ether hardener at 2 weight percent based on total gelatin. The levels of coupler and silver were chosen to approximate the sensitometry of the 4-equivalent check coupler.

Coating Method 3 (4-Equivalent Couplers)

Photographic elements were prepared by coating a gel-subbed, polyethylene-coated paper support with a photosensitive layer containing a silver chloride emulsion at 0.2854 g Ag/m$^2$ for the 4-equivalent coupler C-1. Gelatin was coated at 1.615 g/m$^2$ and C-1 was coated at 0.560 mmol/m$^2$. Comparison coupler C-1 was dispersed with the following addenda (weight percent of coupler): dibutyl phthalate (50%), Addendum-1 (42.6%), and Addendum-2 (10%). The photosensitive layer was overcoated with an ultraviolet absorbing layer containing gelatin at 1.335 g/m$^2$, Addendum-5 at 0.732 g/m$^2$, Addendum-6 at 0.129 g/m$^2$, and Addendum-2 at 0.059 g/m$^2$, and with a protective layer containing gelatin at 1,399 g/m$^2$ and bisvinyl sulfonyl methyl ether hardener at 2 weight percent based on total gelatin.

Coating Method 4 (2-Equivalent Couplers)

Photographic elements were prepared by coating a gel-subbed, polyethylene-coated, neutral pH-adjusted, paper support as described in U.S. Pat No. 4,917,994 with a photosensitive layer containing a silver chloride emulsion at 0.172 g Ag/m$^2$, gelatin at 1.614 g/m$^2$, and the magenta image coupler was coated at 0.329 mmol/m$^2$ dispersed in the following addenda (weight percent of coupler): tricresyl phosphate (100%), Addendum-3 (117%), and Addendum-4 (16.7%) and ethyl acetate (300%). The photosensitive layer was overcoated with an ultraviolet absorbing layer containing gelatin at 1.335 g/m$^2$, Addendum-5 at 0.732 g/m$^2$, Addendum-6 at 0.129 g/m$^2$, and Addendum-2 at 0.059 g/m$^2$, and with a protective layer containing gelatin at 1.399 g/m$^2$ and bisvinyl sulfonyl methyl ether hardener at 2 weight percent based on total gelatin.

Coating Method 5

The photographic elements were prepared by coating the following layers in the order listed on a resin-coated neutral pH-adjusted, paper support as described in U.S. Pat No. 4,917,994:

| | | |
|---|---|---|
| 1st Layer | Gelatin | 3.23 g/m$^2$ |
| 2nd Layer | Gelatin | 1.61 g/m$^2$ |
| | Coupler Disperison | 0.32 mmol/m$^2$ |
| | Silver Chloride Emulsion | 0.172 g/m$^2$ |
| 3rd Layer | Gelatin | 1.33 g/m$^2$ |
| | Addendum-5 | 0.73 g/m$^2$ |
| | Addendum-6 | 0.13 g/m$^2$ |
| 4th Layer | Gelatin | 1.40 g/m$^2$ |
| | Bis(vinylsulfonylmethyl) ether | 0.14 g/m$^2$ |

Addendum-1:

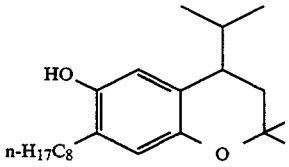

Addendum-2:

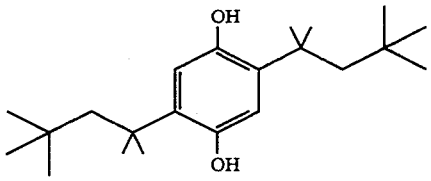

Addendum-3:

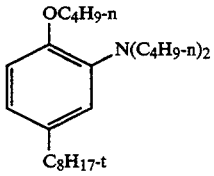

Addendum-4

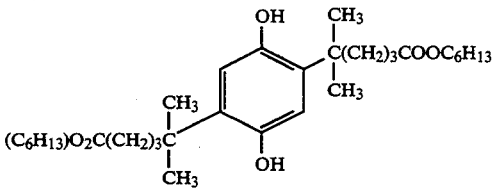

Addendum-5

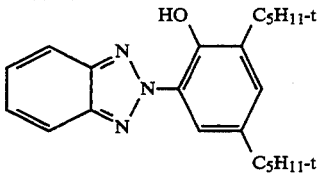

Addendum-6

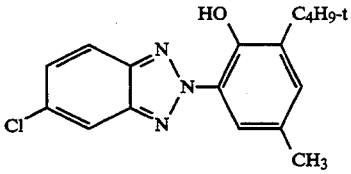

-continued
Addendum-7
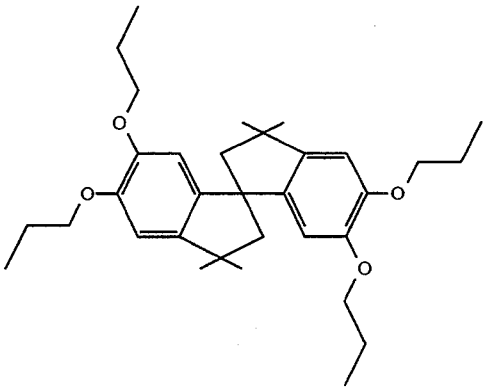
Addendum-8
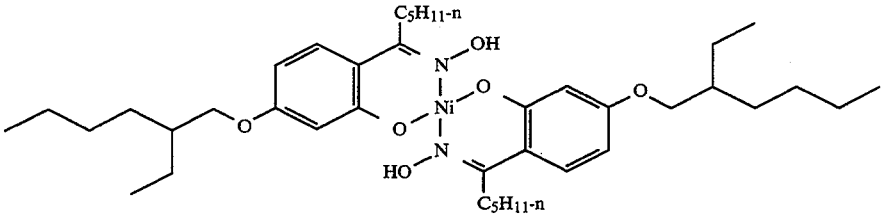
Addendum-9
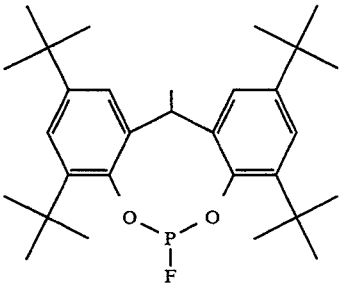
Addendum-10
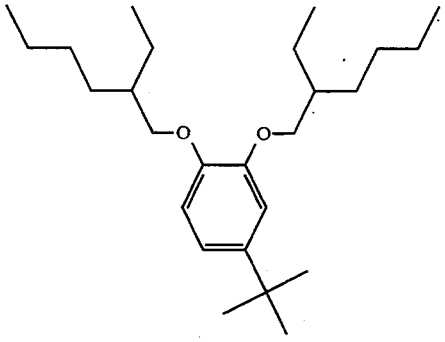
Addendum-11
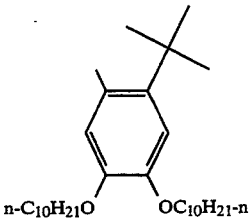
Addendum-12

-continued
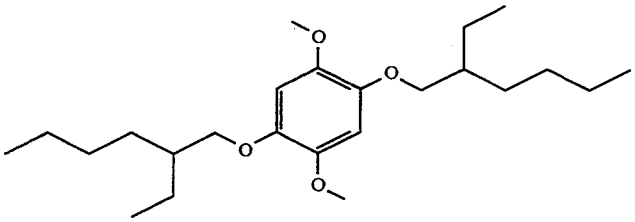
Addendum-13
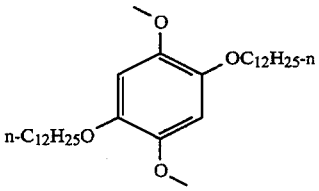
Addendum-14
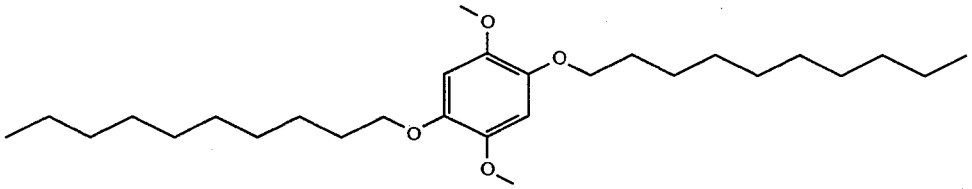
Addendum-15
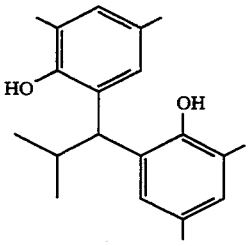
Addendum-16
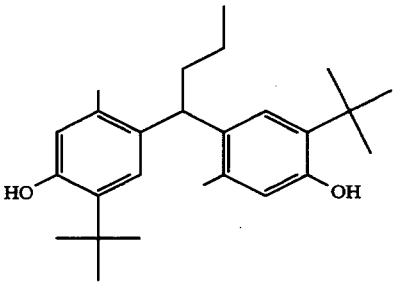
Addendum-17

-continued

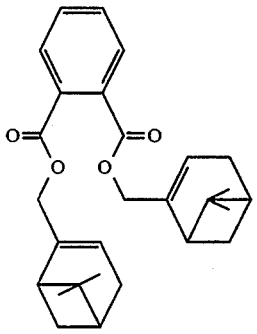

Processing Method 1

Samples of each element were imagewise exposed for 1/10 of a second through a graduated-density test object, then processed in color developer at 35° C. (45 seconds in a color developer, 45 seconds in the bleach-fix bath) washed and dried.

| | |
|---|---|
| Color Developer (pH 10.04) | |
| Triethanolamine | 12.41 g |
| Lithium sulfate | 2.70 g |
| N, N-Diethylhydroxylamine (85% solution) | 5.40 g |
| 1-Hydroxyethylidene-1,1-di-phosphonic acid (60%) | 1.16 g |
| 4-Amino-3-methyl-N-ethyl-N-(β-methanesulfonamido) ethylanilinesulfate hydrate | 5.00 g |
| Potassium carbonate (anhydrous) | 21.16 g |
| Potassium bicarbonate | 2.79 g |
| Potassium chloride | 1.60 g |
| Potassium bromide | 7.0 mg |
| Stilbene whitening agent | 2.30 g |
| Surfactant | 1 mL |
| Water to make | 1.0 L |
| Bleach-Fix Bath (pH 6.8) | |
| Ammonium thiosulfate | 104 g |
| Sodium hydrogen sulfite | 13 g |
| Ferric ammonium ethylenediamine tetraacetic acid (EDTA) | 65.5 g |
| EDTA | 6.56 g |
| Ammonium hydroxide (28%) | 27.9 mL |
| Water to make | 1 L |

Processing Method 2

The photographic elements were given stepwise exposures and processed as follows at 35° C.:

| | |
|---|---|
| Developer | 45 seconds |
| Bleach-Fix | 45 seconds |
| Wash (running water) | 90 seconds |

The developer and bleach-fix were of the following compositions:

| | |
|---|---|
| Developer | |
| Water | 700.00 mL |
| Triethanolamine | 12.41 g |
| Blankophor REU TM (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl)ethylamino] ethyl}methanesulfonamide, sesquisulfate | 5.00 g |
| 1-Hydroxyethyl-1,1-diphosphonic acid (60%) | 0.81 g |
| Potassium carbonate, anhydrous | 21.16 g |

-continued

| | |
|---|---|
| Potassium chloride | 1.60 g |
| Potassium bromide | 7.00 mg |
| Water to make | 1.00 L |
| pH @ 26.7° C. adjusted to 10.4 ± 0.05 | |
| Bleach-Fix | |
| Water | 700.00 mL |
| Solution of ammonium thiosulfate (56.4%) + Ammoniumsulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 6.7 | |

EXAMPLE 1

Hue

The couplers were coated by Methods 1 (4-equivalent) and 2 (2-equivalant) and processed by Method 1. The spectral characteristics (λmax) for the 4-amino-3-methyl-N-ethyl-N-β-(methanesulfonamido)ethylaniline dyes of the representative couplers are summarized in Table III. It is clearly evident that the dye hues of invention couplers are bathochromic to the comparison couplers C-2 through C-7 dye hue, which is desirable for better color reproduction. Check couplers C-8 through C-12 also have acceptable hue, but the thermal stability of the couplers in unprocessed coatings is inferior to couplers of the invention (see raw stock keeping).

Raw Stock Keeping (RSK)

The couplers were coated as described above. The coatings were incubated in a 49° C./50% relative humidity oven for 2 weeks. The coatings were processed as described. The differences in minimum density, relative to check coatings kept at −15° C., are reported in Table III. As is seen, the unprocessed couplers of the invention are uniformly more stable than the comparison 2-equivalent check couplers, especially when comparing the invention couplers to the check couplers with improved hue (couplers C-8 to C-12).

In order to evaluate the combined effect of a coupler on hue and raw stock keeping (RSK), a composite score for each coupler tested was determined based on the following:

| Hue | Score | RSK |
|---|---|---|
| ≧544 | 5 | <.20 |
| 539–543 | 3 | .2–.39 |

-continued

| Hue | Score | RSK |
|---|---|---|
| 534–538 | 1 | .4–.59 |
| <534 | 0 | ≧.60 |

The composite scoring shows that the invention couplers exhibit a distinct improvement over the comparison couplers which would not have been expected. Check coupler C-1 has a good composite score but this coupler is a four-equivalent coupler having the prior art recognized problem of low coupling efficiency compared to the 2 equivalent couplers tested.

TABLE III

Hue and Raw Stock Data

| Coupler | Type | Hue (λmax, nm) | RSK (Δ Dmin) Two Week | Composite Score |
|---|---|---|---|---|
| C-1 | Check | 539 | 0.16 | 8 |
| C-2 | Check | 536 | na | — |
| C-3 | Check | 536 | 0.88 | 1 |
| C-4 | Check | 536 | na | — |
| C-5 | Check | 537 | 1.04 | 1 |
| C-6 | Check | 530 | na | — |
| C-7 | Check | 536 | 0.25 | 4 |
| C-8 | Check | 543 | 0.43 | 4 |
| C-9 | Check | 544 | 0.60 | 5 |
| C-10 | Check | 544 | 0.62 | 5 |
| C-11 | Check | 543 | 0.53 | 4 |
| C-12 | Check | 543 | 0.50 | 4 |
| I-1 | Invention | 543 | 0.32 | 6 |
| I-2 | Invention | 542 | 0.36 | 6 |
| I-5 | Invention | 543 | 0.34 | — |
| I-6 | Invention | 543 | 0.29 | — |
| I-7 | Invention | 543 | 0.36 | 6 |
| I-8 | Invention | 543 | 0.33 | 6 |
| I-9 | Invention | 543 | 0.33 | 6 |
| I-10 | Invention | 543 | 0.29 | 6 |
| I-11 | Invention | 542 | 0.29 | 6 |
| I-12 | Invention | 543 | 0.36 | 6 |
| I-13 | Invention | 543 | 0.24 | 6 |
| I-14 | Invention | 543 | 0.36 | 6 |
| I-15 | Invention | 543 | 0.31 | 6 |
| I-16 | Invention | 544 | 0.26 | 6 |
| I-17 | Invention | 542 | 0.32 | 6 |
| I-18 | Invention | 543 | 0.28 | 6 |
| I-19 | Invention | 542 | 0.36 | 6 |
| I-20 | Invention | 542 | na | — |
| I-21 | Invention | 544 | na | — |
| I-22 | Invention | 543 | 0.36 | 6 |
| I-23 | Invention | 540 | 0.19 | 8 |
| I-24 | Invention | 540 | na | — |
| I-25 | Invention | 541 | 0.24 | 6 |
| I-26 | Invention | 540 | 0.17 | 8 |
| I-27 | Invention | 539 | 0.39 | 6 |
| I-28 | Invention | 543 | 0.12 | 8 |

EXAMPLE 2

Reduction of Calcium Ion Sensitivity

The coupling kinetics of a number of coupler dispersions with oxidized color developer (4-Amino-3-methyl-N- ethyl-N-(β-methanesulfonamido)ethylanilinesesquisulfate hydrate) are determined as a function of the calcium ion concentration by competition with the hydroxide deamination of the oxidized color developer. These competition kinetics are run in a buffer solution (0.0125M of 4-carboxybenzenesulfonamide) containing a maximum of 0.36M potassium ion and a series of calcium ion concentrations (from 0 to 0.16M) with varying potassium ion to maintain a constant total cation level. Known, limited amounts of color developer and excess oxidant (potassium ferricyanide) are added to the dilute dispersions in the buffered media. The relative dye yields are determined spectrophotometrically as a function of the coupler concentration. After corrections for interfering densities, the coupling rate constants are calculated from previously determined rates for oxidized developer deamination as a function of pH by use of standard competition kinetics analysis. For each coupler dispersion the log of the coupling rate constant is plotted as a function of the log of the calcium ion concentration. For all of these coupler dispersions there is a region wherein the coupling rate constants are independent of calcium ion concentration ($k_1$) and a region of decreasing coupling rate with increasing calcium ion concentration. The point of intersection of the calcium ion dependent region and the calcium ion independent region is defined as the threshold, and is reported as the log of the calcium ion concentration for that point. The relative threshold normalizes the values with respect to check coupler C-14. Couplers with a relative threshold of less than 1.00 are more sensitive to calcium ion than couplers with a relative threshold of greater than 1.00. The threshold, the absolute rate constants with no added calcium ion ($k_1$), at a calcium ion concentration of 0.1M ($k_2$), and the difference (Δ log k) are presented in Table IV below. From this information is calculated a relative sensitivity toward calcium ion by normalizing the Δ log k information with respect to check coupler C-14. Couplers with a relative sensitivity of greater than 1.00 are more sensitive toward calcium ion than couplers with a relative threshold of less than 1.00.

As is clearly seen, couplers represented by the invention are less sensitive to the presence of calcium ion in the process than the check couplers. For instance, in comparison to check coupler C-3, invention coupler I-28 has a threshold value nearly 1000 times larger, and is 12 times less sensitive toward calcium ion at a concentration of 0.1M.

TABLE IV

Calcium Ion Sensitivity.

| Coupler | Type | Threshold | Relative Threshold | log $k_1$ | log $k_2$ | Δ log k | Relative Sensitivity |
|---|---|---|---|---|---|---|---|
| C-2 | Check | −4.30 | 0.13 | 2.34 | 1.22 | −1.12 | 1.15 |
| C-3 | Check | −5.29 | 0.01 | 2.90 | 1.33 | −1.57 | 3.24 |
| C-5 | Check | −4.80 | 0.04 | 2.35 | 1.25 | −1.10 | 1.09 |
| C-13 | Check | −4.55 | 0.07 | 2.98 | 1.35 | −1.63 | 3.72 |
| C-14 | Check | −3.40 | 1.00 | 2.60 | 1.54 | −1.06 | 1.00 |
| I-15 | Invention | −2.48 | 8.32 | 3.16 | 2.59 | −0.57 | 0.32 |
| I-23 | Invention | −2.75 | 4.47 | 2.99 | 2.32 | −0.67 | 0.41 |
| I-25 | Invention | −2.63 | 5.88 | 3.36 | 2.84 | −0.52 | 0.29 |
| I-28 | Invention | −2.30 | 12.59 | 3.02 | 2.54 | −0.48 | 0.26 |
| I-29 | Invention | −3.11 | 1.95 | 3.13 | 2.32 | −0.81 | 0.56 |

TABLE IV-continued

| Coupler | Type | Calcium Ion Sensitivity. Threshold | Relative Threshold | log $k_1$ | log $k_2$ | Δ log k | Relative Sensitivity |
|---|---|---|---|---|---|---|---|
| I-30 | Invention | −3.20 | 1.59 | 3.14 | 2.31 | −0.83 | 0.59 |

EXAMPLE 3

Thermal Stability of the Dyes (Fade from an Initial Density of 1.0)

The couplers were coated by Methods 1 (4-equivalent) and 2 (2-equivalent) and processed by Method 1, and the data obtained after treatment under the specified conditions is listed in Table V. The invention couplers give a magenta dye which is much less prone to fade under dry oven conditions than state of the art coupler C-1. The small gains in green density for the invention couplers may be due to an increased covering power phenomenon.

Thermal Stability of the Couplers (Yellowing of the Areas of Minimum Density)

The couplers were coated and processed as described above, and the data obtained after treatment under the specified conditions is listed in Table V. It is clearly evident that couplers of invention are much less prone to discoloration than the check couplers.

TABLE V

| Coupler | Type | Thermal Stability of the Magenta Dyes and Couplers[a,b] Dry Oven Fade (Δ from 1.0) | Wet Oven Fade (Δ from 1.0) | Dry Oven Yellowing (Δ from 0.0) | Wet Oven Yellowing (Δ from 0.0) |
|---|---|---|---|---|---|
| C-1 | Check | −0.22 | −0.12 | 0.11 | 0.15 |
| C-3 | Check | −0.07 | −0.01 | 0.13 | 0.04 |
| I-15 | Invention | −0.03 | 0.02 | 0.09 | 0.03 |
| I-23 | Invention | 0.00 | 0.01 | 0.08 | 0.03 |
| I-25 | Invention | −0.03 | 0.03 | 0.09 | 0.03 |
| I-26 | Invention | −0.02 | 0.01 | 0.09 | 0.03 |
| I-28 | Invention | 0.00 | 0.02 | 0.08 | 0.02 |

[a]Dry Oven Conditions: 4 weeks, 77° C./15% relative humidity.
[b]Wet Oven Conditions: 4 weeks, 60° C./70% relative humidity.

EXAMPLE 4

Coupler Activity:

The couplers were coated by Methods 1 (4-equivalent) and 2 (2-equivalent) and processed as described by Method 1. The data obtained after treatment under the specified conditions is listed in Table VI. The speed and contrast of the invention couplers were greater than check couplers C-3 and C-5.

Leuco-Dye Formation:

The couplers were coated and processed as described above. The processed coatings were exposed to heat and the results are tabulated below. The large increases in density for the check coupler are indicative of the decomposition of a stable leuco-dye to give additional magenta dye upon heat treatment. The couplers of the invention do not form a stable leuco-dyes under these rapid access conditions. Therefore, couplers of the invention do not require Lippman fine grain silver halide for rapid machine processing, a distinct advantage over comparison coupler C-1.

TABLE VI

| Coupler | Type | Coupler Activity and Unwanted Formation of Stable Leuco-Dyes[a,b] Speed at Δ = 1.0) | Contrast | Dry Oven (Δ from 1.7) | Wet Oven (Δ from 1.7) |
|---|---|---|---|---|---|
| C-2 | Check | na | na | 0.23 | 0.26 |
| C-3 | Check | 138 | 2.38 | −0.01 | 0.00 |
| C-5 | Check | 136 | 2.58 | 0.04 | 0.07 |
| I-15 | Invention | 145 | 2.76 | 0.01 | 0.07 |
| I-23 | Invention | 141 | 2.74 | 0.02 | 0.04 |
| I-25 | Invention | 146 | 2.80 | 0.03 | 0.02 |
| I-26 | Invention | 143 | 2.74 | 0.04 | 0.03 |
| I-28 | Invention | 144 | 2.74 | 0.05 | 0.04 |

[a]Dry Oven Conditions: 1 week, 77° C./15% relative humidity.
[b]Wet Oven Conditions: 1 week, 60° C./70% relative humidity.

EXAMPLE 5

Comparison coupler C-1 was coated as described in Coating Method 3 while two-equivalent samples were prepared as described in Coating Method 4. The couplers were processed by Method 2 and were subjected to routine testing for the following characteristics:

Contrast

Contrast is defined as the slope of a line on a plot of density vs. log exposure connecting the points at which the log exposure is 0.3 less and 0.3 greater, respectively, than the log exposure that gave a density of 1.0. The dye hue is defined as the wavelength in nanometers of maximum absorption. Half bandwidth (HBW) is the width of the absorption spectrum in nanometers at half peak height.

Light Stability

Dye light stability is the change in density to green light from an initial density of 1.0 after exposure to simulated daylight at an intensity of 50 klux for a period of four weeks.

Dark Stability

Dye dark stability is the change in density to green light from an initial density of 1.0 after incubation in the dark at 75° C. and 50% relative humidity for a period of four weeks. Yellowing is the change in blue density in a minimum density area after the same incubation conditions.

The results of testing are shown in Tables VII and VIII.

TABLE VII

| Hue and Raw Stock Data | | | | |
|---|---|---|---|---|
| Coupler | Type | Hue (λmax, nm) | RSK (Δ Dmin) Two Week | Composite Score |
| C-1 | Check | 539 | 0.09 | 8 |
| C-2 | Check | 536 | 0.53 | 2 |
| C-5 | Check | 537 | 0.44 | 2 |
| I-28 | Invention | 543 | 0.12 | 8 |
| I-31 | Invention | 542 | 0.25 | 6 |
| I-32 | Invention | 542 | 0.25 | 6 |
| I-33 | Invention | 542 | 0.26 | 6 |
| I-34 | Invention | 542 | 0.29 | 6 |
| I-35 | Invention | 542 | 0.15 | 8 |

The composite scoring shows that the invention couplers exhibit a distinct improvement over the comparison couplers which would not have been expected. Check coupler C-1 has a good composite score but this coupler is a four-equivalent coupler having the prior art recognized problem of low coupling efficiency compared to the 2 equivalent couplers tested.

TABLE VIII

| Coupler Evaluation Data | | | | | |
|---|---|---|---|---|---|
| Coupler | Type | Contrast | Dye Light Stability | Dye Dark Stability | Yellowing |
| C-1 | Check | 2.64 | −0.73 | −0.13 | 0.19 |
| C-2 | Check | 1.45 | −0.91 | 0.18 | 0.07 |
| C-5 | Check | 2.56 | −0.52 | 0.01 | 0.11 |
| I-28 | Inven. | 2.76 | −0.64 | 0.02 | 0.11 |
| I-31 | Inven. | 2.69 | −0.56 | 0.01 | 0.14 |
| I-32 | Inven. | 2.64 | −0.68 | 0.00 | 0.10 |
| I-33 | Inven. | 2.61 | −0.65 | 0.00 | 0.13 |
| I-34 | Inven. | 2.76 | −0.61 | −0.01 | 0.09 |
| I-35 | Inven | 2.73 | −0.59 | 0.00 | 0.10 |

A comparison of the results of Table VIII shows that the invention provides couplers with improved activity (as measured by the contrast), dye stability, and yellowing performance relative to the check couplers. Although check coupler C-5 provides comparable dye stability and yellowing performance, its hue is undesirable as was shown in Table VII. As was shown previously in Example 4, Table VI, check coupler C-2 is prone to leuco-dye formation as evidenced both by its poor contrast and dye density gain upon dark keeping.

EXAMPLE 6

The example described the use of the invention couplers with {100} silver chloride tabular emulsion as prepared as described in EP 534,395. The eulsions were then coated by Method 5 on a resin coated paper support and processed by Method 2.

Preparation of Photographic Elements

Each of the coupler dispersions used consisted of a disperse phase of the composition shown in Table IX and a dispersion medium comprising aqueous gelatin and an emulsifying agent. The dispersions were emulsified by methods well known in the photographic art.

TABLE IX

| | Disperse Phase Composition |
|---|---|
| A | I-31, 30%; Addendum-3, 35%; Addendum-4, 5%; tricresyl phosphate, 30% |
| B | I-31, 30%; Addendum-7, 40%; tricresyl phosphate, 30% |
| C | I-31, 30%; Addendum-1, 40%; tricresyl phosphate, 30% |
| D | I-31, 30%; Addendum-3, 40%; tricresyl phosphate, 30% |
| E | I-31, 30%; Addendum-7, 20%; Addendum-8, 20%; tricresyl phosphate, 30% |

TABLE IX-continued

| | Disperse Phase Composition |
|---|---|
| F | I-31, 30%; Addendum-7, 20%; Addendum-3, 20%; tricresyl phosphate, 30% |
| G | I-31, 30%; Addendum-7, 30%; Addendum-9, 10%; tricresyl phosphate, 30% |
| H | I-31, 30%; Addendum-7, 35%; Addendum-4, 5%; tricresyl phosphate, 30% |
| I | I-31, 30%; Addendum-3, 35%; Addendum-4, 5%; tris(2-ethylhexyl)phosphate, 30% |

Photographic Tests on Coating Examples 601 to 609

The material was processed as described above and the following photographic characteristics were determined: D-max (the maximum density to light of the color complimentary to the dye color); D-min (the minimum density); and Speed (the relative log exposure required to yield a density of 1.0). These values for each example are tabulated in Table X.

TABLE X

| Example No. | Dispersion | D-max | D-min | Speed |
|---|---|---|---|---|
| 601 | A | 2.13 | 0.21 | 240 |
| 602 | B | 2.46 | 0.30 | 252 |
| 603 | C | 1.36 | 0.29 | 214 |
| 604 | D | 2.44 | 0.30 | 250 |
| 605 | E | 2.45 | 0.32 | 254 |
| 606 | F | 2.45 | 0.27 | 255 |
| 607 | G | 2.48 | 0.29 | 255 |
| 608 | H | 2.24 | 0.24 | 242 |
| 609 | I | 2.15 | 0.21 | 241 |

Table X demonstrates that the invention couplers are useful in combination with {100} silver chloride tabular emulsions in a variety of dispersion formulations commonly used for color paper reflection print materials.

EXAMPLE 7

This example shows the usefulness of the invention couplers in a variety of dispersion formulations. The emulsions were then coated by Method 5 on a resin coated paper support and processed by Method 2.

Preparation of Photographic Elements

Each of the coupler dispersions used consisted of a disperse phase of the composition shown in Table XI and a dispersion medium comprising aqueous gelatin and an emulsifying agent. The dispersions were emulsified by methods well known in the photographic art.

TABLE XI

| | Disperse Phase Composition |
|---|---|
| J | I-31, 30%; Addendum-3, 17.5%; Addendum-7, 8.75%; Addendum-10, 8.75%; Addendum-4, 5%; tricresyl phosphate, 30% |
| K | I-31, 30%; Addendum-3, 17.5%; Addendum-7, 17.5%; Addendum-4, 5%; tris(2-ethylhexyl)phosphate, 30% |
| L | I-31, 30%; Addendum-3, 17.5%; Addendum-11, 17.5%; Addendum-4, 5%; tris(2-ethylhexyl)phosphate, 30% |
| M | I-31 30%; Addendum-3, 17.5%; Addendum-10, 17.5%; Addendum-4, 5%; tris(2-ethylhexyl)phosphate, 30% |
| N | I-31, 30%; Addendum-3, 17.5%; Addendum-12, 17.5%; Addendum-4, 5%; tris(2-ethylhexyl)phosphate, 30% |
| O | I-31, 30%; Addendum-3, 17.5%; Addendum-13, 17.5%; Addendum-4, 5%; tris(2-ethylhexyl)phosphate, 30% |
| P | I-31, 30%; Addendum-3, 17.5%; Addendum-14, 17.5%; Addendum-4, 5%; tris(2-ethylhexyl)phosphate, 30% |
| Q | I-31, 30%; Addendum-3, 17.5%; Addendum-1, 17.5%; Addendum-4, 5%; tris(2-ethylhexyl)phosphate, 30% |
| R | I-31, 30%; Addendum-3, 17.5%; 1,2-benzenedicarboxylic acid, bis(2-ethoxyethyl) ester, 17.5%; Addendum-4, 5%; tris(2-ethylhexyl)phosphate, 30% |

TABLE XI-continued

| | Disperse Phase Composition |
|---|---|
| S | I-31, 30%; Addendum-3, 17.5%; 1,2-benzenedicarboxylic acid, bis(2-(2-ethoxyethoxy)ethyl) ester, 17.5%; Addendum-4, 5%; tris(2-ethylhexyl)phosphate, 30% |
| T | I-31, 30%; Addendum-3, 25%; Addendum-15, 10%; Addendum-4, 5%; tris(2-ethylhexyl)phosphate, 30% |
| U | I-31, 30%; Addendum-3, 25%; Addendum-16, 10%; Addendum-4, 5%; tris(2-ethylhexyl)phosphate, 30% |
| V | I-31, 30%; Addendum-3, 35%; Addendum-4, 5%; tris(2-ethylhexyl)phosphate, 30% |
| W | I-31, 30%; Addendum-3, 35%; Addendum-4, 5%; dibutyl phthalate, 30% |
| X | I-31, 30%; Addendum-3, 35%; Addendum-4, 5%; 1,2-benzenedicarboxylic acid, bis(1,1-diethylpropyl) ester, 30% |
| Y | I-31, 30%; Addendum-3, 35%; Addendum-4, 5%; Addendum-17, 30% |

Photographic Tests on Coating Examples 701 to 716

The material was processed as described above and the following photographic characteristics were determined: D-max (the maximum density to light of the color complimentary to the dye color); D-min (the minimum density); and Speed (the relative log exposure required to yield a density of 1.0). These values for each example are tabulated in Table XII.

TABLE XII

| Example No. | Dispersion | D-max | D-min | Speed |
|---|---|---|---|---|
| 701 | J | 2.55 | 0.09 | 144 |
| 702 | K | 2.46 | 0.09 | 145 |
| 703 | L | 2.48 | 0.09 | 145 |
| 704 | M | 2.48 | 0.09 | 145 |
| 705 | N | 2.48 | 0.09 | 146 |
| 706 | O | 2.49 | 0.09 | 146 |
| 707 | P | 2.50 | 0.09 | 145 |
| 708 | Q | 2.39 | 0.09 | 137 |
| 709 | R | 2.49 | 0.10 | 146 |
| 710 | S | 2.50 | 0.09 | 145 |
| 711 | T | 2.43 | 0.09 | 139 |
| 712 | U | 2.42 | 0.09 | 140 |
| 713 | V | 2.46 | 0.10 | 141 |
| 714 | W | 2.57 | 0.10 | 140 |
| 715 | X | 2.40 | 0.10 | 133 |
| 716 | Y | 2.43 | 0.10 | 133 |

Table XII demonstrates that the invention couplers are useful in a variety of dispersion formulations commonly used for color paper reflection print materials.

The invention has been described in detail with particular reference to preferred embodiments thereof, but it will be understood that variations and modifications can be effected within the spirit and scope of the invention.

What is claimed is:

1. A photographic element comprising a support bearing at least one silver halide emulsion layer having associated therewith a 5-pyrazolone photographic coupler represented by the formula:

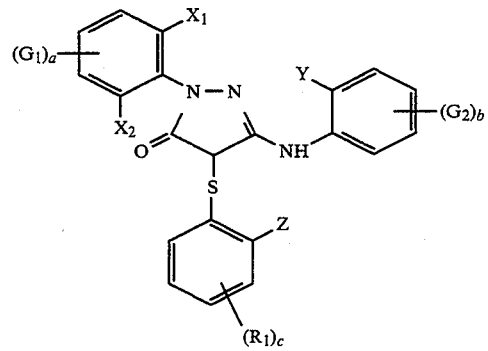

wherein a) substituents $X_1$, $X_2$, Y, $G_1$, and $G_2$ are individually selected from the group consisting of halogen, alkyl, alkoxy, aryloxy, acylamino, alkylthio, arylthio, sulfonamido, sulfamoyl, sulfamido, carbamoyl, diacylamino, alkoxycarbonyl, aryloxycarbonyl, alkoxysulfonyl, aryloxysulfonyl, alkylsulfonyl, alkylsulfoxyl, arylsulfoxyl, arylsulfonyl, alkoxycarbonylamino, aryloxycarbonylamino, alkylureido, arylureido, acyloxy, nitro, cyano, trifluoromethyl and carboxy and, in the case of $X_1$, $X_2$ and Y, hydrogen;

b) a, b, and c are individually integers from 0 to 3 provided that "a" cannot be an integer which, combined with the selection of $X_1$ and $X_2$, allows the number of chloride substituents on the ring containing $G_1$ to exceed 3;

c) $R_1$ is selected from the group consisting of $G_1$ and hydroxyl;

d) Z is an amine group of the formula:

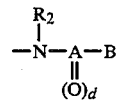

wherein $R_2$ is selected from the group consisting of hydrogen, alkyl, alkenyl, aryl, acyl, and heterocyclic;

A is carbon and d is 1;

B is comprised of (1) an atom of oxyqen, nitrogen, sulfur, or carbon bonded to A, said atom also bonded to (2) a substituent selected from the group consisting of alkyl, aryl, and heterocyclic groups, wherein, when said atom bonded to A is carbon, B has the formula:

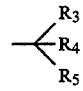

wherein $R_3$, $R_4$, and $R_5$ are individually selected from the group consisting of hydrogen, halogen, alkyl, aryl, heterocyclic group and W, wherein W is selected from the group consisting of —$OR_6$, —$SR_6$, and —$NR_7R_8$, wherein $R_6$ is selected from the group consisting of alkyl, aryl, and heterocyclic groups, and $R_7$ and $R_8$ are individually selected from the group consisting of hydrogen, alkyl, aryl, acyl, alkylsulfonyl, arylsulfonyl and heterocyclic group, provided that, when A is carbon, at least one of $R_3$, $R_4$, and $R_5$ is not hydrogen or alkyl and provided that two of $R_3$, $R_4$, and $R_5$ may join to form an aliphatic, aromatic, or heterocyclic ring and that in the case of an aromatic ring the remaining member of $R_3$, $R_4$, and $R_5$ is an aromatic pi bond, and in the case of a nonaromatic unsaturated aliphatic or heterocyclic ring the remaining member may be a bond forming part of a double bond in the ring; and e) the sum of the sigma values for $X_1$,$X_2$,$G_1$,$G_2$, and Y is at least 1.3.

2. The element of claim 1 wherein B is bonded to A by an oxygen atom in B.

3. The element of claim 1 wherein B is bonded to A by a sulfur atom in B.

4. The element of claim 1 wherein B is bonded to A by a nitrogen atom in B.

5. The element of claim 1 wherein B is bonded to A by a carbon atom in B.

6. The element of claim 5 wherein at least one of $R_3$, $R_4$ and $R_5$ is an aryloxy substituent.

7. The element of claim 6 wherein said aryloxy substituent is an alkylaryloxy substituent.

8. The element of claim 6 wherein at least one of $R_3$, $R_4$ and $R_5$ is alkyl.

9. The element of claim 1 wherein two of $R_3$, $R_4$and $R_5$ are joined to form an aliphatic ring.

10. The element of claim 1 wherein the substituents $X_1$, $X_2$, Y, $G_1$, and $G_2$ are individually selected from the group consisting of chloride, fluoride, cyano, acylamino, sulfamoyl, carbamoyl, alkoxycarbonyl, and alkylsulfonyl and in the case of $X_1$, $X_2$ and Y, hydrogen.

11. The element of claim 1 wherein the sum of the pi values for the substituents Z and $R_1$ is at least 2.5.

12. The element of claim 1 additionally comprising a layer of magnetic particles.

13. The element of claim 12 additionally comprising a yellow colored dye forming masking coupler.

14. A photographic element comprising a support bearing at least one silver halide emulsion layer having associated therewith a 5-pyrazolone photographic coupler represented by the formula:

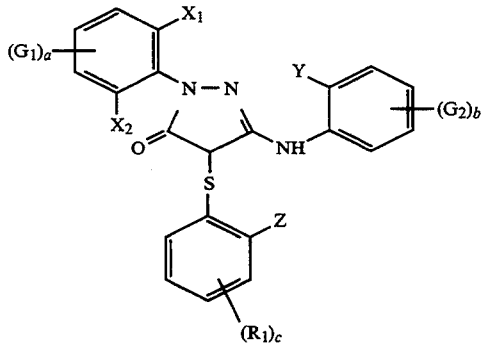

wherein a) substituents $X_1$, $X_2$, Y, $G_1$, and $G_2$ are individually selected from the group consisting of halogen, alkyl, alkoxy, aryloxy, acylamino, alkylthio, arylthio, sulfonamido, sulfamoyl, sulfamido, carbamoyl, diacylamino, alkoxycarbonyl, aryloxycarbonyl, alkoxysulfonyl, aryloxysulfonyl, alkylsulfonyl, alkylsulfoxyl, arylsulfoxyl, arylsulfonyl, alkoxycarbonylamino, aryloxycarbonylamino, alkylureido, arylureido, acyloxy, nitro, cyano, trifluoromethyl and carboxy and, in the case of $X_1$, $X_2$ and Y, hydrogen;

b) a, b, and c are individually integers from 0 to 3 provided that "a" cannot be an integer which, combined with the selection of $X_1$ and $X_2$, allows the number of chloride substituents on the ring containing $G_1$ to exceed 3;

c) $R_1$ is selected from the group consisting of $G_1$ and hydroxyl;

d) Z is an amine group of the formula:

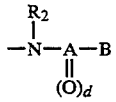

wherein $R_2$ is selected from the group consisting of hydrogen, alkyl, alkenyl, aryl, acyl, and heterocyclic;

A is carbon and d is 1;

B is comprised of (1) an atom of oxygen, nitrogen, sulfur, or carbon bonded to A, said atom also bonded to (2) a substituent selected from the group consisting of alkyl, aryl, and heterocyclic groups, wherein, when said atom bonded to A is carbon, B has the formula:

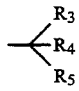

wherein $R_3$, $R_4$, and $R_5$ are individually selected from the group consisting of hydrogen, halogen, alkyl, aryl, heterocyclic group and W, wherein W is selected from the group consisting of —$OR_6$, —$SR_6$, and —$NR_7R_8$, wherein $R_6$ is selected from the group consisting of alkyl, aryl, and heterocyclic groups, and $R_7$ and $R_8$ are individually selected from the group consisting of hydrogen, alkyl, aryl, acyl, alkylsulfonyl, arylsulfonyl and heterocyclic group, provided that, when A is carbon, at least one of $R_3$, $R_4$, and $R_5$ is not hydrogen or alkyl and provided that two of $R_3$, $R_4$, and $R_5$ may join to form an aliphatic, aromatic, or heterocyclic ring; and e) the sum of the sigma values for $X_1$,$X_2$,$G_1$,$G_2$, and Y is at least 1.3.

* * * * *